US010163392B2

(12) United States Patent
Imai

(10) Patent No.: US 10,163,392 B2
(45) Date of Patent: Dec. 25, 2018

(54) ACTIVE MATRIX DISPLAY DEVICE AND METHOD FOR DRIVING SAME

(71) Applicant: Sharp Kabushiki Kaisha, Sakai, Osaka (JP)

(72) Inventor: Masahiro Imai, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/563,718

(22) PCT Filed: Mar. 31, 2016

(86) PCT No.: PCT/JP2016/060687

§ 371 (c)(1),
(2) Date: Oct. 2, 2017

(87) PCT Pub. No.: WO2016/163299

PCT Pub. Date: Oct. 13, 2016

(65) Prior Publication Data

US 2018/0068615 A1 Mar. 8, 2018

(30) Foreign Application Priority Data

Apr. 7, 2015 (JP) ..... 2015-078599

(51) Int. Cl.
*G09G 3/36* (2006.01)
*G09G 3/3225* (2016.01)

(52) U.S. Cl.
CPC ..... *G09G 3/3225* (2013.01); *G09G 3/3677* (2013.01); *G09G 2310/0297* (2013.01);
(Continued)

(58) Field of Classification Search
CPC .. G09G 3/3225; G09G 3/3648; G09G 3/3677; G09G 2310/0297; G09G 2320/0219; G09G 2320/0247
See application file for complete search history.

(56) References Cited

U.S. PATENT DOCUMENTS 5,995,075 A * 11/1999 Vignolle ..... G09G 3/3648 345/100
2003/0063048 A1* 4/2003 Nakano ..... G09G 3/3648 345/55

(Continued)

FOREIGN PATENT DOCUMENTS

JP 2002-169513 A 6/2002
JP 2002-358052 A 12/2002

(Continued)

OTHER PUBLICATIONS

Official Communication issued in International Patent Application No. PCT/JP2016/060687, dated Jun. 21, 2016.

*Primary Examiner* — Richard Hong
(74) *Attorney, Agent, or Firm* — Keating & Bennett, LLP

(57) ABSTRACT

The present invention provides an active matrix display device capable of producing a favorable display on a non-rectangular display unit, such as a circular display unit. In an active matrix liquid crystal display device with a circular display unit, a control signal Sck is generated so as to reduce a decrease amount ΔVsl of a data signal line voltage Vsl due to a parasitic capacitance Cgd, as a control signal of an Nch transistor (SWk) that is a switching element of a sample-and-hold circuit for sampling a video signal Svi and holding the sampled signal in a data signal line capacitance. That is, at the time of turning off the Nch transistor (SWk), a connection switch control signal Sck is generated such that the control signal Sck changes from an H-level connection control voltage VCH as an on-voltage to an L-level connection control voltage VCL as an off-voltage through a period TCI for an intermediate level voltage VCI.

11 Claims, 15 Drawing Sheets

(52) U.S. Cl.
CPC ..... *G09G 2320/0219* (2013.01); *G09G 2320/0247* (2013.01)

(56) References Cited

U.S. PATENT DOCUMENTS

| | | | |
|---|---|---|---|
| 2010/0141570 | A1 | 6/2010 | Horiuchi et al. |
| 2010/0289785 | A1 | 11/2010 | Sawabe |

FOREIGN PATENT DOCUMENTS

| | | | |
|---|---|---|---|
| JP | 2003-114657 | A | 4/2003 |
| JP | 2006-184718 | A | 7/2006 |
| WO | 2008/032468 | A1 | 3/2008 |
| WO | 2009/054166 | A1 | 4/2009 |
| WO | 2012/023467 | A1 | 2/2012 |

* cited by examiner

ACTIVE MATRIX DISPLAY DEVICE AND METHOD FOR DRIVING SAME

TECHNICAL FIELD

The present invention relates to an active matrix display device and a method for driving the same, which provide an analog video signal to each of a plurality of data signal lines connected to a plurality of pixel formation portions for forming an image to be displayed.

BACKGROUND ART

In a display device such as an active matrix liquid crystal display device, a plurality of data signal lines (also referred to as "source lines"), a plurality of scanning signal lines (also referred to as "gate lines") that intersect with the plurality of data signal lines, and a plurality of pixel formation portions arranged in a matrix form along the plurality of data signal lines and the plurality of scanning signal lines are formed in a display unit of a liquid crystal panel or the like. Some of such active matrix display devices have employed a dot sequential driving system or an SSD (Source Shared Driving) system. The SSD system is a system in which the plurality of data signal lines in the display unit are divided into a plurality of data signal line groups, with a predetermined number of (two or more) data signal lines set as one group, and an analog video signal is provided to the predetermined number of data signal lines in each group in a time-division manner.

In the active matrix display device, when the dot sequential driving system or the SSD system is employed, an analog video signal is provided to each data signal line via an analog switch in an on-state, and then a level of a control signal for the analog switch is changed to bring the analog switch into an off-state, thereby holding a voltage of the analog video signal on the data signal line. Any of the above plurality of scanning signal lines is activated (selected) while the voltage of the analog video signal is held on each data signal line as thus described, whereby the voltage of the data signal line is written as pixel data into the pixel formation portion connected to the activated scanning signal line.

FIG. 9 is a circuit diagram showing a configuration of a portion (hereinafter referred to as "unit sample-and-hold circuit") corresponding to one data signal line SLk in a sample-and-hold circuit for sampling an analog video signal and holding the sampled signal on each data signal line SLi (i=1 to N) in the display device as described above. This unit sample-and-hold circuit includes an N-channel field effect transistor (hereinafter abbreviated as "Nch transistor") SWk as an analog switch, and a parasitic capacitance Cgd formed between a gate terminal of this Nch transistor SWk and one conductive terminal thereof which is connected to the data signal line SLk. An analog video signal Sv1 is provided to the other conductive terminal of the Nch transistor SWk, and a control signal Sck for controlling the on-off of the Nch transistor SWk is provided to the gate terminal of the Nch transistor SWk. The Nch transistor SWk (including the parasitic capacitance Cgd) as above constitutes a sampling circuit of the analog video signal Sv1, and this sampling circuit and a capacitance Csl of the data signal line SLk (a total capacitance formed by the data signal line SLk and the other electrodes) constitute the unit sample-and-hold circuit.

In the above sampling circuit, at the time of turning on the analog switch, an on-voltage (a high-level voltage (hereinafter referred to as "H-level voltage") when the analog switch is made up of the Nch transistor) is provided as the control signal Sck to the gate terminal of the Nch transistor SWk, and at the time of turning off the analog switch, an off-voltage (a low-level voltage (hereinafter referred to as "L-level voltage") when the analog switch is made up of the Nch transistor) is provided as the control signal Sck to the gate terminal of the Nch transistor SWk.

As shown in FIG. 10, when the H-level voltage VCH is provided as the control signal Sck to the gate terminal of the Nch transistor SWk, this Nch transistor SWk enters the on-state, and the analog video signal Sv1 is provided to the data signal line SLk via this Nch transistor SWk. As a result, a voltage Vsl of the data signal line SLk (hereinafter referred to as "data signal line voltage") becomes equal to a voltage Vv1 of the analog video signal Sv1. Thereafter, when the voltage provided to the gate terminal of the Nch transistor SWk as the control signal Sck changes from an H-level voltage VCH to an L-level voltage VCL, the Nch transistor SWk enters the off-state. At this time, the voltage change (VCH to VCL) in the gate terminal of the Nch transistor SWk has an influence on the data signal line voltage Vsl via the parasitic capacitance Cgd, and the data signal line voltage Vsl decreases from the voltage Vv1 of the analog video signal Sv1 in accordance with the voltage change. This voltage decrease amount ΔVsl is expressed by the following formula, assuming that the above voltage change instantly occurs (assuming that the Nch transistor SWk instantly shifts to the off-state):

$$\Delta Vsl=\{Cgd/(Csl+Cgd)\}(VCH-VCL) \quad (1)$$

Further, in the active matrix liquid crystal display device, also in each pixel formation portion, a voltage Vp of a pixel electrode (hereinafter referred to as "pixel voltage") decreases due to a parasitic capacitance in a transistor (normally a thin-film transistor) as a pixel switching element at the time of turning off the switching element (hereinafter assumed to be made up of the Nch transistor) (see FIGS. 14 and 15). At this time, the pixel voltage decrease amount ΔVp is expressed by the following formula, where a pixel capacitance is represented by "Cp", assuming that a voltage of a scanning signal that is provided to the gate terminal of the Nch transistor instantly changes from an H-level gate voltage VGH as the on-voltage to an L-level gate voltage VGL as the off-voltage, namely, the Nch transistor as the pixel switching element instantly shifts to the off-state:

$$\Delta Vp=\{Cgd/(Cp+Cgd)\}(VGH-VGL) \quad (2)$$

As an invention related to the present application, Patent Document 1 describes an invention of an active matrix display device of the SSD system. For the purpose of reducing power consumption in driving a switch unit for data-line selection, this display device is provided with a switch unit drive circuit configured so as to switch a voltage level between an on-voltage and an off-voltage of a data line selection signal through a period for an intermediate voltage. Further, Patent Document 2 describes an invention of a liquid crystal display panel scanning line driver configured such that a scanning line driving voltage (output signal) does not fall abruptly, but shows a gentle falling waveform in accordance with a drive capability of a switching element. This invention is aimed to prevent flickering of the screen by taking a measure capable of reducing a variation ΔV in a display electrode voltage that occurs when the output signal of the scanning line driver shifts from "H" to "L".

PRIOR ART DOCUMENTS

Patent Documents

[Patent Document 1] Japanese Patent Application Laid-Open No. 2003-114657

[Patent Document 2] Japanese Patent Application Laid-Open No. 2002-169513

[Patent Document 3] Japanese Patent Application Laid-Open No. 2006-184718

SUMMARY OF THE INVENTION

Problems to be Solved by the Invention

Although the display unit of the active matrix display device is normally rectangular, there has also been proposed an active matrix display device with a display unit in a shape other than a rectangular, such as circular (hereinafter referred to as "non-rectangular") shape, depending on the application. In such an active matrix display device with the non-rectangular display unit, the capacitance Csl of each data signal line is not fixed, but varies depending on the data signal line. Hence, the voltage decrease amount ΔVsl shown in the above formula (1) also varies depending on the data signal line. As a result, an influence exerted by the voltage decrease on the display quality is large as compared with the display device with the rectangular display unit.

In the active matrix display device with the non-rectangular display unit, the voltage decrease amount ΔVsl, generated due to the parasitic capacitance of the Nch transistor as the analog switch in the sampling circuit, varies depending on the data signal line as described above, whereby the display unevenness occurs to prevent a favorable display.

In such an active matrix display device with the non-rectangular display unit, the capacitance Cgl of each scanning signal line is not fixed, but varies depending on the data signal line. Since the scanning signal line capacitance Cgl is not included in the above formula (2), when the Nch transistor as the pixel switching element instantly enters the off-state, namely when the scanning signal connected to the gate terminal of the Nch transistor instantly changes from the on-voltage VGH to the off-voltage VGL, the pixel voltage decrease amount ΔVp does not change due to the scanning signal line. In practice, however, this scanning signal does not instantly change from the on-voltage VGH to the off-voltage VGL due to the presence of the scanning signal line capacitance Cgl, and the falling waveform of the scanning signal thus becomes dull. The dullness of the falling waveform increases (the fall time becomes longer) with increase in the scanning signal line capacitance Cgl, and an amount of charges that flow into the pixel electrode (pixel capacitance) increases in the changing process of the scanning signal voltage from the on-voltage VGH to the off-voltage VGL. Therefore, when the display unit is in a circular or some other shape, each scanning signal line capacitance Cgl varies depending on the scanning signal line, and hence the pixel voltage decrease amount ΔVp varies depending on the scanning signal line connected to the pixel switching element. As a result, the display unevenness occurs to prevent a favorable display.

Accordingly, an object of the present invention is to provide an active matrix display device and a method for driving the same, capable of producing a favorable display on a non-rectangular display unit, such as a circular display unit.

Solutions to the Problem

A first aspect of the present invention provides an active matrix display device including:

a display unit including a plurality of data signal lines, a plurality of scanning signal lines intersecting with the plurality of data signal lines, and a plurality of pixel formation portions arranged in a matrix form along the plurality of data signal lines and the plurality of scanning signal lines, the display unit having a non-rectangular shape in which lengths of at least two data signal lines of the plurality of data signal lines are different from each other;

an analog switch provided correspondingly to each of the plurality of data signal lines and including, as a connection control switching element, a field effect transistor which has a first conductive terminal configured to receive an analog video signal to be provided to the pixel formation portion connected to the corresponding data signal line, a second conductive terminal connected to the corresponding data signal line, and a control terminal configured to receive a connection switch control signal for switching between an on-state and an off-state; and a connection control circuit configured to generate the connection switch control signal such that time taken for a voltage of the connection switch control signal to change from a first level voltage for bringing the connection control switching element into an on-state to a second level voltage for bringing the connection control switching element into an off-state in turning off the connection control switching element is predetermined time in accordance with a length of time required for charging or discharging of a parasitic capacitance between the control terminal and the second conductive terminal via the connection control switching element.

A second aspect of the present invention provides the active matrix display device according to the first aspect of the present invention, wherein the connection control circuit generates the connection switch control signal such that the voltage of the connection switch control signal changes in a continuous manner from the first level voltage to the second level voltage or to a voltage in a vicinity of the second level voltage in turning off the connection control switching element.

A third aspect of the present invention provides the active matrix display device according to the second aspect of the present invention, wherein the connection control circuit generates the connection switch control signal such that the voltage of the connection switch control signal changes in a stepwise manner from the first level voltage to the second level voltage through at least one period for an intermediate level voltage in turning off the connection control switching element.

A fourth aspect of the present invention provides the active matrix display device according to the first aspect of the present invention, wherein the connection control circuit generates the connection switch control signal such that, the longer the corresponding data signal line, the shorter the predetermined time in the connection switch control signal to be provided to the control terminal of the connection control switching element.

A fifth aspect of the present invention provides the active matrix display device according to any one of the first to fourth aspects of the present invention, the active matrix display device further including a scanning signal line drive circuit configured to generate a plurality of scanning signals to be respectively provided to the plurality of scanning signal lines, wherein the display unit has a non-rectangular shape in which lengths of at least two scanning signal lines of the plurality of scanning signal lines are different from each other, each of the plurality of pixel formation portions includes a pixel electrode as one of electrodes that forms a predetermined capacitance, and a field effect transistor as a pixel switching element which has a first conductive terminal connected to any one of the plurality of data signal lines, a second conductive terminal connected to the pixel electrode, and a control terminal connected to any one of the plurality of scanning signal lines, and the scanning signal line drive circuit generates the plurality of scanning signals such that time taken for a voltage of the scanning signal provided to the control terminal to change from a third level voltage for bringing the pixel switching element into an on-state to a fourth level voltage for bringing the pixel switching element into an off-state in turning off the pixel switching element is predetermined time in accordance with a length of time required for charging or discharging of a parasitic capacitance between the control terminal and the second conductive terminal of the pixel switching element via the pixel switching element.

A sixth aspect of the present invention provides an active matrix display device including:

a display unit including a plurality of data signal lines, a plurality of scanning signal lines intersecting with the plurality of data signal lines, and a plurality of pixel formation portions arranged in a matrix form along the plurality of data signal lines and the plurality of scanning signal lines, the display unit having a non-rectangular shape in which lengths of at least two scanning signal lines of the plurality of scanning signal lines are different from each other; and a scanning signal line drive circuit configured to generate a plurality of scanning signals to be respectively provided to the plurality of scanning signal lines, wherein each of the plurality of pixel formation portions includes a pixel electrode as one of electrodes that forms a predetermined capacitance, and a field effect transistor as a pixel switching element which has a first conductive terminal connected to any one of the plurality of data signal lines, a second conductive terminal connected to the pixel electrode, and a control terminal connected to any one of the plurality of scanning signal lines, and the scanning signal line drive circuit generates the plurality of scanning signals such that time taken for a voltage of the scanning signal provided to the control terminal to change from a third level voltage for bringing the pixel switching element into an on-state to a fourth level voltage for bringing the pixel switching element into an off-state in turning off the pixel switching element is predetermined time in accordance with a length of time required for charging or discharging of a parasitic capacitance between the control terminal and the second conductive terminal via the pixel switching element.

A seventh aspect of the present invention provides the active matrix display device according to the fifth or sixth aspect of the present invention, wherein the scanning signal line drive circuit generates the plurality of scanning signals such that the voltage of the scanning signal that is provided to the control terminal of the pixel switching element changes in a continuous manner from the third level voltage to the fourth level voltage or to a voltage in a vicinity of the fourth level voltage in turning off the pixel switching element.

A eighth aspect of the present invention provides the active matrix display device according to the fifth or sixth aspect of the present invention, wherein the scanning signal line drive circuit generates the plurality of scanning signals such that the voltage of the scanning signal that is provided to the control terminal of the pixel switching element changes in a stepwise manner from the third level voltage to the fourth level voltage through at least one period for an intermediate voltage in turning off the pixel switching element.

A ninth aspect of the present invention provides the active matrix display device according to the fifth or sixth aspect of the present invention, wherein the scanning signal line drive circuit generates the plurality of scanning signals such that, the longer the scanning signal line, the shorter the predetermined time in the scanning signal to be provided to the scanning signal line.

A tenth aspect of the present invention provides a method for driving an active matrix display device provided with a display unit including a plurality of data signal lines, a plurality of scanning signal lines intersecting with the plurality of data signal lines, and a plurality of pixel formation portions arranged in a matrix form along the plurality of data signal lines and the plurality of scanning signal lines, the display unit having a non-rectangular shape in which lengths of at least two data signal lines of the plurality of data signal lines are different from each other, the method comprising the steps of:

controlling supply of an analog video signal to the corresponding data signal line by an analog switch provided correspondingly to each of the plurality of data signal lines and including, as a connection control switching element, a field effect transistor which has a first conductive terminal configured to receive the analog video signal to be provided to the pixel formation portion connected to the corresponding data signal line, a second conductive terminal connected to the corresponding data signal line, and a control terminal configured to receive a connection switch control signal for switching between an on-state and an off-state; and generating the connection switch control signal such that time taken for a voltage of the connection switch control signal to change from a first level voltage for bringing the connection control switching element into an on-state to a second level voltage for bringing the connection control switching element into an off-state in turning off the connection control switching element is predetermined time in accordance with a length of time required for charging or discharging of a parasitic capacitance between the control terminal and the second conductive terminal via the connection control switching element.

A eleventh aspect of the present invention provides the method according to the tenth aspect of the present invention, the method further including a scanning signal line driving step of generating a plurality of scanning signals to be respectively provided to the plurality of scanning signal lines, wherein the display unit has a non-rectangular shape in which lengths of at least two scanning signal lines of the plurality of scanning signal lines are different from each other, each of the plurality of pixel formation portions includes a pixel electrode as one of electrodes that forms a predetermined capacitance, and a field effect transistor as a pixel switching element which has a first conductive terminal connected to any one of the plurality of data signal lines, a second conductive terminal connected to the pixel electrode, and a control terminal connected to any one of the plurality of scanning signal lines, and in the scanning signal line driving step, the plurality of scanning signals are generated such that time taken for a voltage of the scanning signal provided to the control terminal of the pixel switching element to change from a third level voltage for bringing the pixel switching element into an on-state to a fourth level voltage for bringing the pixel switching element into an off-state in turning off the pixel switching element is predetermined time in accordance with a length of time required for charging or discharging of a parasitic capacitance between the control terminal and the second conductive terminal of the pixel switching element via the pixel switching element.

Other aspects of the present invention will become clear from the first to eleventh aspects of the present invention and description of embodiments to be given later, and therefore will not be stated here.

Effects of the Invention

According to the first aspect of the present invention, the time taken for the voltage of the connection switch control signal to change from the first level voltage as the on-voltage to the second level voltage as the off-voltage in turning off the analog switch provided on each data signal line, namely in an off-shift process of the field effect transistor as the connection control switching element is a predetermined time in accordance with a length of time required for charging or discharging of the parasitic capacitance between the control terminal and the second conductive terminal of the connection control switching element via the connection control switching element. Thus, charge-transfer to the data signal line or charge-transfer from the data signal line occurs via the connection control switching element in the off-shift process, thereby reducing a variation in data signal line voltage due to the parasitic capacitance between the control terminal and the second conductive terminal of the connection control switching element. This also leads to reducing a difference in variation amount of the data signal line voltage which is generated due to the data signal lines having different lengths in the non-rectangular display unit. Therefore, a favorable display with reduced display unevenness can be produced also in the non-rectangular display unit such as the circular display unit.

According to the second aspect of the present invention, the voltage of the connection switch control signal changes in a continuous manner from the first level voltage as the on-voltage to the second level voltage as the off-voltage or to a voltage in the vicinity of the second level voltage in the predetermined time at the time of turning off the analog switch provided on each data signal line (in the off-shift process). Thus, charge-transfer to the data signal line or charge-transfer from the data signal line occurs via the connection control switching element in the off-shift process, thereby bringing about a similar effect to that of the first aspect of the present invention.

According to the third aspect of the present invention, the voltage of the connection switch control signal changes in a stepwise manner from the first level voltage as the on-voltage to the second level voltage as the off-voltage through at least one intermediate level voltage period at the time of turning off the analog switch provided on each data signal line (in the off-shift process). Charges transfer to the data signal line via the connection control switching element in the period of the intermediate level voltage in the off-shift process, thereby bringing about a similar effect to that of the first aspect of the present invention.

According to the fourth aspect of the present invention, the longer the data signal line corresponding to the connection control switching element, the shorter the predetermined time corresponding to the off-shift process in the connection switch control signal to be provided to the control terminal of the connection control switching element, whereby the voltage variation amounts of the data signal lines in the off-shift process of the connection control switching element are made more uniform in the display unit. It is thereby possible to produce a favorable display with the display unevenness more effectively reduced in the non-rectangular display unit.

According to the fifth aspect of the present invention, when the connection control switching element in each analog switch is in the on-state, the analog video signal provided to the first conductive terminal of the connection control switching element is provided to the corresponding data signal line, and when the connection control switching element is turned off, the analog video signal is held as a data signal line voltage on (the capacitance of) the corresponding data signal line. Meanwhile, in each pixel formation portion, when the pixel switching element is in the on-state, the voltage of the data signal line connected to the first conductive terminal of the pixel switching element, namely the voltage indicating the analog video signal, is provided to the pixel electrode, and when the pixel switching element is turned off, the voltage is held as a pixel voltage in a predetermined capacitance having the pixel electrode (pixel capacitance). The time taken for the voltage of the scanning signal provided to the control terminal to change from the third level voltage as the on-voltage to the fourth level voltage as the off-voltage in the off-shift process of the pixel switching element is a predetermined time in accordance with a length of time required for charging or discharging of the parasitic capacitance between the control terminal and the second conductive terminal of the pixel switching element via the pixel switching element. Therefore, charge-transfer to the pixel electrode or charge-transfer from the pixel electrode occurs via the pixel switching element in the off-shift process of the pixel switching element, thereby reducing a variation in pixel voltage due to the parasitic capacitance between the control terminal and the second conductive terminal of the pixel switching element. Thus, this aspect leads to reducing not only a difference in variation amount of the data signal line voltage which is generated due to the data signal lines having different lengths, but also a difference in variation amount of the pixel voltage which is generated due to the scanning signal lines having different lengths, in the non-rectangular display unit. It is thereby possible to produce a favorable display with reduced display unevenness in the non-rectangular display unit such as the circular display unit.

According to the sixth aspect of the present invention, in each pixel formation portion, when the pixel switching element is in the on-state, the voltage of the data signal line connected to the first conductive terminal of the pixel switching element is provided to the pixel electrode, and when the pixel switching element is turned off, the voltage is held as a pixel voltage in a predetermined capacitance having the pixel electrode (pixel capacitance). The time taken for the voltage of the scanning signal provided to the control terminal to change from the third level voltage as the on-voltage to the fourth level voltage as the off-voltage in the off-shift process of the pixel switching element is a predetermined time in accordance with a length of time required for charging or discharging of the parasitic capacitance between the control terminal and the second conductive terminal of the pixel switching element via the pixel switching element. Thus, charge-transfer to the pixel electrode or charge-transfer from the pixel electrode occurs via the pixel switching element in the off-shift process of the pixel switching element, thereby reducing a variation in pixel voltage due to the parasitic capacitance between the control terminal and the second conductive terminal of the pixel switching element. This leads to reducing a difference in variation amount of the pixel voltage which is generated due to the scanning signal lines having different lengths in the non-rectangular display unit. It is thereby possible to produce a favorable display with reduced display unevenness in the non-rectangular display unit such as the circular display unit.

According to the seventh aspect of the present invention, the voltage of the scanning signal that is provided to the control terminal of the pixel switching element changes in a continuous manner from the third level voltage as the on-voltage to the fourth level voltage as the off-voltage or to a voltage in the vicinity of the fourth level voltage in the predetermined time at the time of turning off the pixel switching element in each pixel formation portion (in the off-shift process). Thus, charges transfer via the pixel switching element in the off-shift process, thereby bringing about a similar effect to that of the sixth aspect of the present invention.

According to the eighth aspect of the present invention, the voltage of the scanning signal that is provided to the control terminal of the pixel switching element changes in a stepwise manner from the third level voltage as the on-voltage to the fourth level voltage as the off-voltage through at least one intermediate level voltage period at the time of turning off the pixel switching element in each pixel formation portion (in the off-shift process). Charges transfer via the pixel switching element in the period of the intermediate level voltage in the off-shift process, thereby bringing about a similar effect to that of the sixth aspect of the present invention.

According to the ninth aspect of the present invention, the longer the scanning signal line to which the scanning signal is to be provided, the shorter the predetermined time corresponding to the off-shift process of the pixel switching element in the scanning signal, whereby the variation amounts of the pixel voltages in the off-shift process of the pixel switching element are made more uniform in the display unit. It is thereby possible to produce a favorable display with the display unevenness more effectively reduced in the non-rectangular display unit.

According to the tenth aspect of the present invention, in the method for driving the active matrix display device, a similar effect to that of the first aspect of the present invention is obtained.

According to the eleventh aspect of the present invention, in the method for driving the active matrix display device, a similar effect to that of the fifth aspect of the present invention is obtained.

Effects of the other aspects of the present invention are apparent from the effects of the above first to eleventh aspects of the present invention and description of the following embodiments, and hence the description thereof are omitted.

MODES FOR CARRYING OUT THE INVENTION

Embodiments of the present invention will be described below with reference to the accompanying drawings.

1. First Embodiment

<1.1 Overall Configuration>

Figure 1:
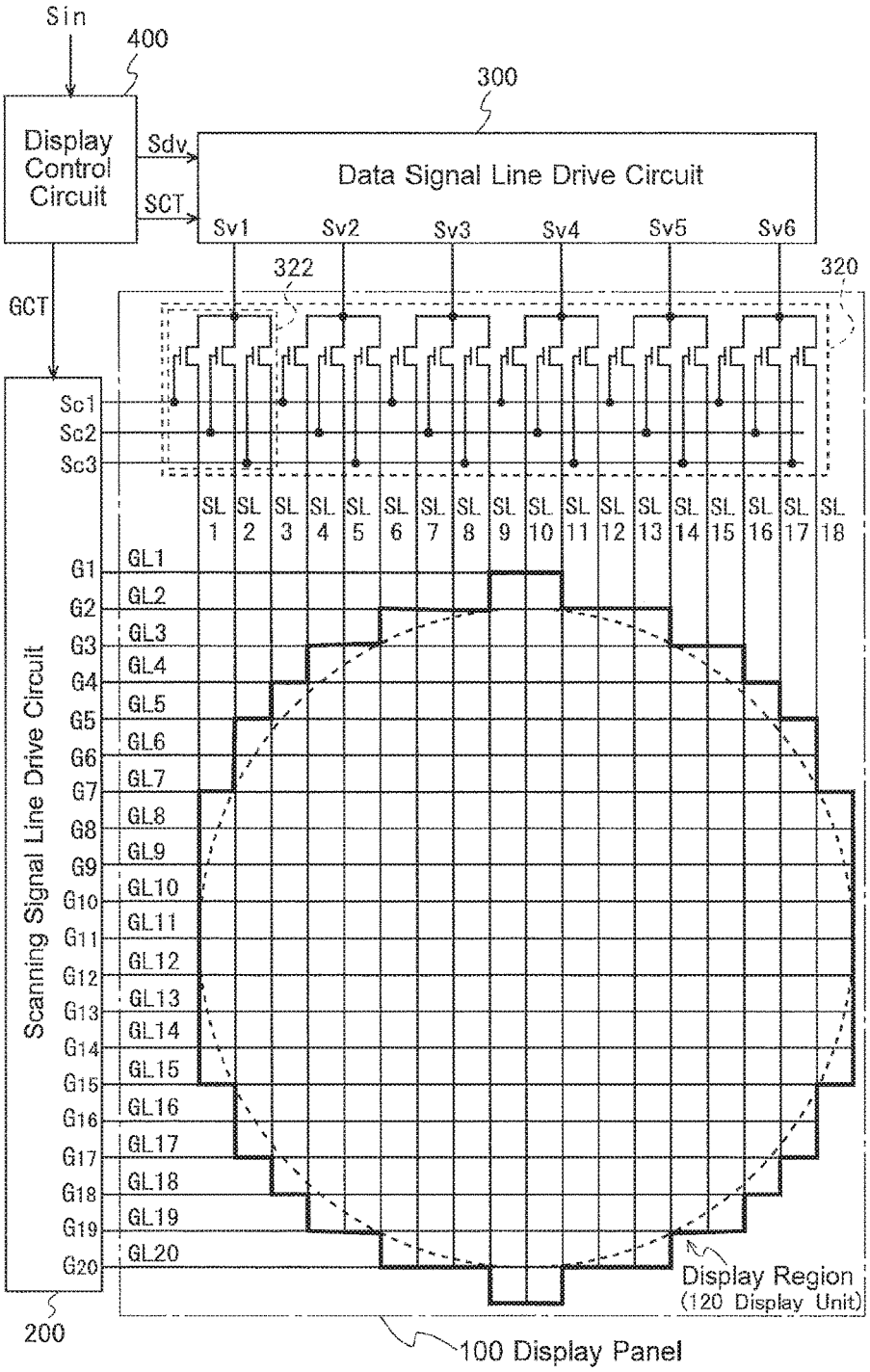
FIG. 1 is a block diagram showing a configuration of a liquid crystal display device according to a first embodiment of the present invention.

FIG. 1 is a block diagram showing an overall configuration of a liquid crystal display device according to a first embodiment of the present invention. This liquid crystal display device is provided with a display panel 100 including a circular active matrix display unit 120, a scanning signal line drive circuit (also referred to as "gate driver") 200, a data signal line drive circuit (also referred to as "source driver") 300, and a display control circuit 400, and the display panel 100 includes a demultiplex circuit 320 described later. An input signal Sin is externally provided to the display control circuit 400, and this input signal Sin contains an image signal for representing an image to be displayed and a timing control signal for displaying the image.

The display unit 120 is provided with a plurality of (3n) data signal lines (also referred to as "source lines") SL1 to SL3*n*, a plurality of (m) scanning signal lines (also referred to as "gate lines") GL1 to GLm, and a plurality of (m×3n) pixel formation portions 10 arranged in a matrix form (hereinafter, such a plurality of pixel formation portions arranged in a matrix form are also referred to as "pixel matrix") along the data signal lines SL1 to SL3*n* and the scanning signal lines GL1 to GLm. In FIG. 1, for the convenience of illustration, n=6 and m=20.

Figure 2:
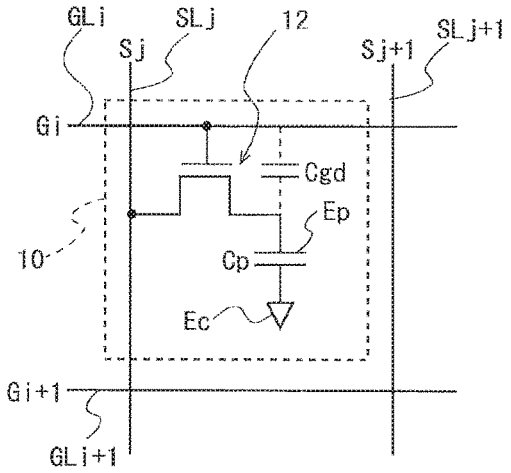
FIG. 2 is a circuit diagram showing an equivalent circuit of a pixel formation portion in the first embodiment.

Each pixel formation portion 10 corresponds to any one of these data signal lines SL1 to SL3*n* and also corresponds to any one of these scanning signal lines GL1 to GLm. Hereinafter, when 3n data signal lines SL1 to SL3*n* are not discriminated, these are simply referred to as a "data signal line SL", and when m scanning signal lines GL1 to GLm are not discriminated, these are simply referred to as a "scanning signal line GL." As shown in FIG. 2, each pixel formation portion 10 includes: a thin film transistor (hereinafter abbreviated as "TFT") 12 serving as a switching element, connected at its gate terminal as a control terminal to a corresponding scanning signal line GLi, and connected at its source terminal to a corresponding data signal line SLj; a pixel electrode Ep connected to a drain terminal of the TFT 12; a common electrode Ec provided so as to be shared by the m×3n pixel formation portions 10; and a liquid crystal layer provided so as to be sandwiched between the pixel electrode Ep and the common electrode Ec and shared by the m×3n pixel formation portions 10. A liquid crystal capacitance formed of the pixel electrode Ep and the common electrode Ec constitutes a pixel capacitance Cp. Although an auxiliary capacitance is typically provided in parallel with the liquid crystal capacitance so as to reliably hold a voltage in the pixel capacitance Cp, the auxiliary capacitance is not directly related to the present invention, and thus the description and illustration thereof are omitted.

As described later, a parasitic capacitance Cgd is present between the gate terminal and the drain terminal of the TFT 12 as a switching element in each pixel formation portion 10 (hereinafter referred to as "pixel switching element"), and this parasitic capacitance Cgd includes a capacitance formed of the scanning signal line GLi and the pixel electrode Ep. The kind of TFT 12 is not particularly limited, and for a channel layer of the TFT 12, any of amorphous silicon, polysilicon, microcrystalline silicon, continuous grain silicon (CG silicon), and oxide semiconductor may be used (this also applies to a TFT as a switching element, included in the demultiplex circuit 320 described later.) The system of the display panel as the display panel 100 including the display unit 120 is not limited to the VA (Vertical Alignment) system where an electric field is applied in a direction vertical to the liquid crystal layer, the TN (Twisted Nematic) system, or the like, and the system may be the IPS (In-Plane Switching) system where an electric field is applied in a direction substantially parallel to the liquid crystal layer.

The display control circuit 400 externally receives the input signal Sin, and based on this received input signal Sin, the display control circuit 400 generates and outputs a digital image signal Sdv, a data-side control signal SCT, a scanning-side control signal GCT, and a common voltage Vcom (not shown). The digital image signal Sdv and the data-side control signal SCT are provided to the data signal line drive circuit 300, the scanning-side control signal GCT is provided to the scanning signal line drive circuit 200, and the common voltage Vcom is provided to the common electrode Ec in the display unit 120.

Based on the digital image signal Sdv and the data-side control signal SCT, the data signal line drive circuit 300 generates n video signals Sv1 to Svn as data signals for driving the display panel 100. That is, the data-side control signal SCT from the display control circuit 400 contains a source start pulse signal SSP, a source clock signal SCK, a latch strobe signal Ls, a polarity switch control signal Cpn, and the like, and based on these signals, the data signal line drive circuit 300 actuates a shift register, a sampling latch circuit, and the like, which are provided on the inside and not shown, to generate n digital signals based on the digital image signal Sdv, and converts these digital signals to analog signals by a DA converter circuit (not shown) to generate n video signals Sv1 to Svn as signals for driving the display panel 100. These video signals Sv1 to Svn are analog voltage signals, and provided to the demultiplex circuit 320. Note that the polarity switch control signal Cpn is a control signal for AC driving the display unit 120 so as to prevent degradation of liquid crystal, and is used for switching the polarities of the video signals Sv1 to Svn at predetermined timing. While this AC drive is known by a person skilled in the art, it is not directly related to the feature of the present invention, and hence the detailed description thereof is omitted.

The demultiplex circuit 320 is formed on the display panel 100 integrally with the display unit 120, and the demultiplex circuit 320 receives the video signals Sv1 to Svn (n=6 in FIG. 1) from the data signal line drive circuit 300 and respectively provides these video signals Sv1 to Svn to the data signal lines SL1 to SL3*n* as 3*n* data signals S1 to S3*n* by the SSD system. That is, in the present embodiment, the SSD system is employed in the display panel 100, where the data signal lines are divided into n data signal line groups (i=1 to n), with adjacent three data signal lines SL3*i*-2, SL3*i*-1, SL3*i* set as one group, and a demultiplexer 322 corresponding to each group provides a video signal to the three data signal lines in the group in a time-division manner. Connection switch control signals Sc1 to Sc3 for switching the data signal line, to which a video signal Svi is to be provided as a data signal, in accordance with the SSD system, are generated in the scanning signal line drive circuit 200 as described later in the present embodiment.

Figure 3:
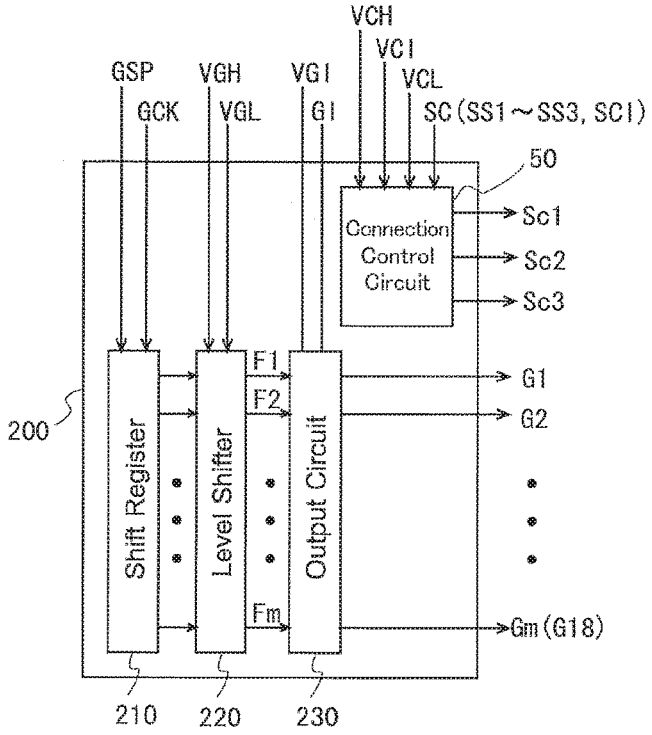
FIG. 3 is a block diagram showing a configuration example of a scanning signal line drive circuit in the first embodiment.

The scanning signal line drive circuit 200 generates scanning signals G1 to Gm based on the scanning-side control signal GCT and applies the generated signals to the scanning signal lines GL1 to GLm, and thereby repeats application of the active scanning signals to the scanning signal lines GL1 to GLm in a predetermined cycle. FIG. 3 is a block diagram showing a configuration example of the scanning signal line drive circuit 200. The scanning signal line drive circuit 200 according to this configuration example is provided with a shift register 210, a level shifter 220, and an output circuit 230, and further provided with a connection control circuit 50 for generating the connection switch control signals Sc1 to Sc3. The scanning-side control signal GCT from the display control circuit 400 contains a gate clock signal GCK and a gate start pulse signal GSP, and further contains a gate intermediate-level period signal GI and a connection control signal SC described later. Further, the following voltages are also provided to the scanning signal line drive circuit 200 from a power circuit (not shown): an H-level connection control voltage VCH as an on-voltage (first level voltage) for turning on a TFT as a switching element (hereinafter referred to as "connection control switching element") in the demultiplex circuit 320; an L-level connection control voltage VCL as an off-voltage (second level voltage) for turning off the connection control switching element; an intermediate level connection control voltage VCI showing an intermediate level between these voltages VCH and VCL; an H-level gate voltage VGH as an on-voltage (third level voltage) for turning on the TFT 12 as the pixel switching element; an L-level gate voltage VGL as an off-voltage (fourth level voltage) for turning off the TFT 12; and an intermediate level gate voltage VGI showing an intermediate level between these gate voltages VGH and VGL.

Figure 4:
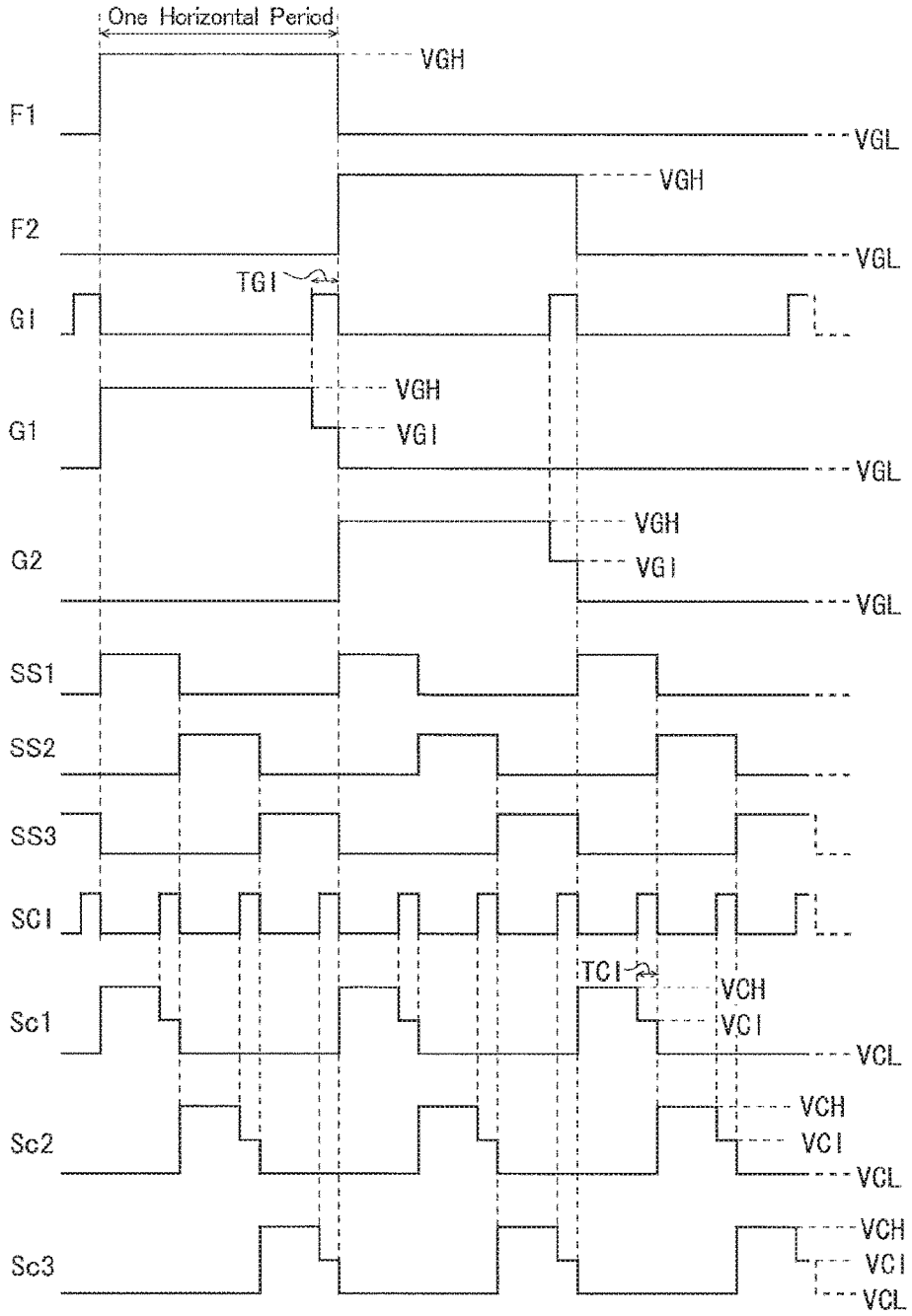
FIG. 4 is a signal waveform diagram for describing generation of a scanning signal and a connection switch control signal in the first embodiment.

In the scanning signal line drive circuit 200 as above, the shift register 210 sequentially transfers on the inside a start pulse contained in the gate start pulse signal GSP in accordance with the gate clock signal GCK, and accordingly, each stage of the shift register 210 outputs an active signal. The level shifter 220 converts the levels of the signals outputted from the shift register 210 based on the L-level gate voltage VGL and the H-level gate voltage VGH, and outputs the converted signals as scanning-side internal signals F1 to Fm as shown in FIG. 4. Based on the intermediate level gate voltage VGI and the gate intermediate-level period signal GI, the output circuit 230 corrects the scanning-side internal signals F1 to Fm such that a fall of each of the scanning-side internal signals F1 to Fm (a change from the H-level gate voltage VGH to the L-level gate voltage VGL, more generally a change from the on-voltage to the off-voltage of the pixel switching element) occurs through an intermediate level period, and outputs the corrected signals as scanning signals G1 to Gm as shown in FIG. 4. In the fall of each scanning signal Gi (i=1 to m) generated as above, the signal first changes from the H-level gate voltage VGH to the intermediate level gate voltage VGI and is kept at the intermediate level gate voltage VGI just during a period TGI indicated by the gate intermediate-level period signal, and then changes to the L-level gate voltage VGL.

Based on the H-level connection control voltage VCH, the L-level connection control voltage VCL, and the connection control signal SC, the connection control circuit 50 in the scanning signal line drive circuit 200 generates the connection switch control signals Sc1 to Sc3, and provides the generated signals to each demultiplexer 322 in the demultiplex circuit 320. The connection control signal SC is made up of first to third connection timing signals SS1 to SS3 and a connection control intermediate-level period signal SCI as shown in FIG. 4. The first connection timing signal SS1 is active (on a high level (H-level) in the present embodiment) just during a period when a video signal Svj is to be provided to a first data signal line SL3*j*-2 among data signal lines SL3*j*-2, SL3*j*-1, SL3*j* (j=1 to n) in each group, the second connection timing signal SS2 is active (H-level) just during a period when the video signal Svj is to be provided to the second data signal line SL3*j*-1, and the third connection timing signal SS3 is active (H-level) just during a period when the video signal Svj is to be provided to the third data signal line SL3*j*. That is, the first to third connection timing signals SS1 to SS3 are on the H-level during first to third periods obtained by dividing each horizontal period into three periods as described later.

The connection control circuit 50 converts the voltage levels of the first to third connection timing signals SS1 to SS3 based on the H-level connection control voltage VCH and the L-level connection control voltage VCL, and corrects the connection timing signals SS1 to SS3 based on the intermediate level connection control voltage VCI and the connection control intermediate-level period signal SCI such that a fall of each of the first to third connection timing signals SS1 to SS3 (a change from the H-level connection control voltage VCH to the L-level connection control voltage VCL, more generally a change from the on-voltage to the off-voltage of the connection control switching element) occurs through the intermediate level, and outputs the corrected signals as first to third connection switch control signals Sc1 to Sc3 as shown in FIG. 4. In the fall of each connection switch control signal Sck (k=1, 2, 3) generated as above, the signal first changes from the H-level connection control voltage VCH to the intermediate level connection control voltage VCI, and is kept at the intermediate level connection control voltage VCI just during a period TCI indicated by the connection control intermediate-level period signal SCI, and then changes to the L-level connection control voltage VCL. As described above, these first to third connection switch control signals Sc1 to Sc3 are provided to the demultiplex circuit 320, and used there as control signals for switching the data signal line to which each video signal Svi is to be provided among the data signal lines SL3*i*-2, SL3*i*-1, SL3*i* in the corresponding group.

The rear surface side of the display panel 100 is provided with a back light unit (not shown), and the rear surface of the display panel 100 is thereby irradiated with a back light beam. This back light unit is also driven by the display control circuit 400, but may be configured to be driven by another method. When the display panel 100 is of a reflective type, the back light unit is not necessary.

As described above, the data signals S1 to S3*n* are respectively provided to the data signal lines SL1 to SL3*n*, the scanning signals G1 to Gm are respectively applied to the scanning signal lines GL1 to GLm, and the rear surface of the display panel 100 is irradiated with the back light beam, whereby an image represented by the externally provided input signal Sin is displayed on the display unit 120 that constitutes a display region of the display panel 100.

Note that in the above configuration shown in FIGS. 1 to 3, the connection control circuit 50, which generates the connection switch control signals Sc1 to Sc3 to be provided to the demultiplex circuit 320, is included in the scanning signal line drive circuit 200, but it may instead be included in the display control circuit 400. Further, both or one of the data signal line drive circuit 300 and the scanning signal line drive circuit 200 may be provided in the display control circuit 400. Moreover, both or one of the data signal line drive circuit 300 and the scanning signal line drive circuit 200 may be formed integrally with the display unit 120.

<1.2 Drive of Display Unit>

Figure 5:
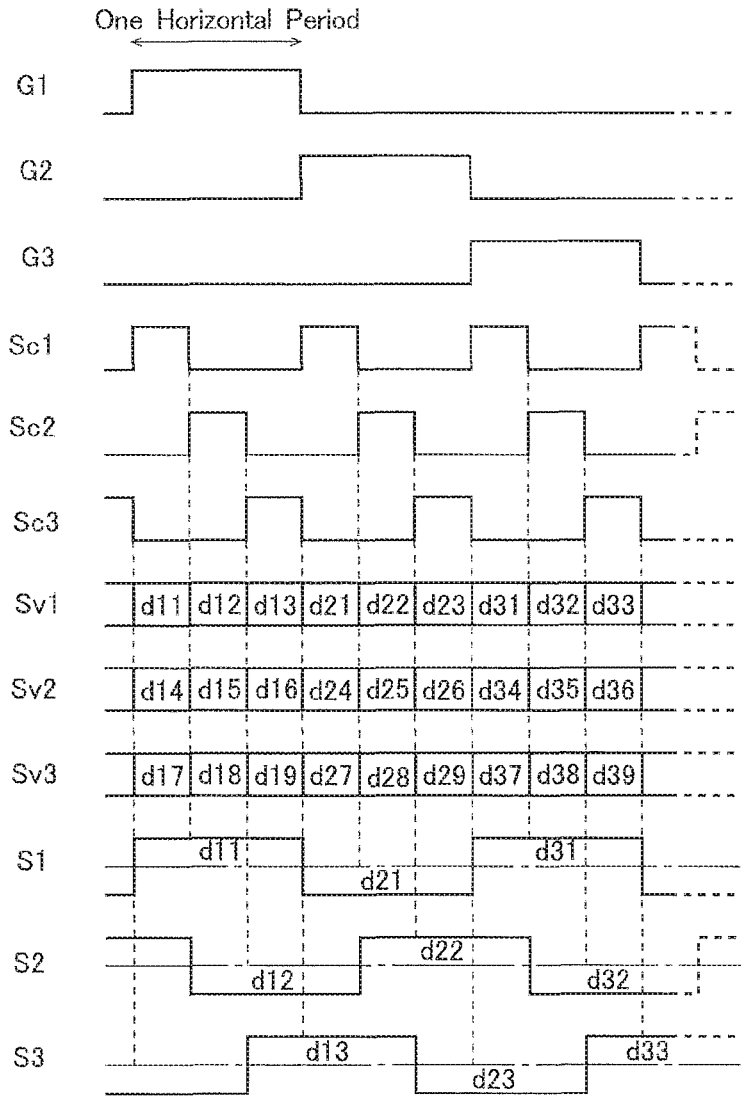
FIG. 5 is a timing chart for describing operation of a driving unit (a scanning signal line drive circuit, a data signal line drive circuit, and a demultiplex circuit) of the display unit in the first embodiment.

FIG. 5 is a timing chart for describing operation of a driving unit that drives the display unit 120 in the present embodiment. This driving unit is made up of the scanning signal line drive circuit 200, the data signal line drive circuit 300, and the demultiplex circuit 320. Hereinafter, with reference to FIG. 5 together with FIG. 1, a description will be given of the operation of this driving unit, namely the drive of the data signal lines SL1 to SL3*n* and the scanning signal lines GL1 to GLm in the display unit 120. Note that FIG. 5 illustrates waveforms of the scanning signals G1 to Gm and the connection switch control signals Sc1 to Sc3 as simple rectangular waves with the time for rising and falling, the intermediate level in the falling, and the like eliminated for the sake of convenience. Although the TFT as the pixel switching element and the TFT as the connection control switching element are both Nch transistors in the present embodiment, both or one of these TFTs may be Pch field effect transistors (hereinafter referred to as "Pch transistors").

The scanning signals G1 to Gm respectively applied to the scanning signal lines GL1 to GLm from the scanning signal line drive circuit 200 sequentially become active in each a horizontal period, like the scanning signals G1 to G3 shown in FIG. 5. In the present embodiment, since the TFT as the pixel switching element and the TFT as the connection control switching element are the Nch transistors, the high level (H-level) is taken as active and the low level (L-level) is taken as non-active, but when the Pch transistors are used, the L-level is taken as active and the H-level is taken as non-active.

The demultiplex circuit 320 includes n demultiplexers 322, the i-th video signal Svi is inputted into the i-th demultiplexer 322 (i=1 to n), and the connection switch control signals Sc1 to Sc3 as shown in FIG. 5 are inputted into each demultiplexer 322. When periods obtained by dividing each horizontal period into three are referred to as first, second, and third periods, the first connection switch control signal Sc1 among these connection switch control signals Sc1 to Sc3 is active just during the first period, the second connection switch control signal Sc2 is active just during the second period, and the third connection switch control signal Sc3 is active just during the third period. Each demultiplexer 322 is connected with three data signal lines SL3*i*-2, SL3*i*-1, SL3*i*, to which the video signal Svi is to be applied in a time-division manner, the video signal being to be inputted into the demultiplexer 322. Each demultiplexer 322 provides the video signal Svi to the data signal line SL3*i*-2 when the first connection switch control signal Sc1 is active (H-level), provides the video signal Svi to the data signal line SL3*i*-1 when the second connection switch control signal Sc2 is active (H-level), and provides the video signal Svi to the data signal line SL3*i* when the third connection switch control signal Sc3 is active (H-level). Accordingly, the data signal line, to which the video signal Svi is to be provided, is switched among the three data signal lines SL3*i*-2, SL3*i*-1, SL3*i* in each horizontal period.

By such operation, the data signals S1 to S3 shown in FIG. 5 are respectively applied to the data signal lines SL1 to SL3. In a similar manner, the data signals are applied to the other data signal lines SL3*i*-2, SL3*i*-1, SL3*i* (i=2 to n). Symbol dij added to each of the video signals Svi to Sv3 and the data signals S1 to S3 in FIG. 5 denotes pixel data to be written into the pixel formation portion 10 connected to the i-th scanning signal line GLi and the j-th data signal line SLj (i=1 to m, j=1 to 3n). A capacitance is formed between each data signal line SLj and the other electrodes (the common electrode Ec, an electrode constituting the scanning signal line GL, etc.) (hereinafter, this capacitance is referred to as "data signal line capacitance Csl"). By the function of this data signal line capacitance Csl and the demultiplexer 322, the video signal Svi is sampled by the connection switch control signal Sck to be held on the data signal line SL3(*i*−1)+k (i=1 to n; k=1, 2, 3) (see the data signals S1 to S3 in FIG. 5). Note that the polarity of the video signal Svi changes (not shown) in accordance with the polarity switch control signal Cpn described above, and accordingly, the polarities of the data signals S3*i*-2, S3*i*-1, S3*i* also change (see FIG. 5).

In FIG. 5, it is assumed that a system is employed where the display panel 100 is driven such that the polarity of the data signal provided to each pixel formation portion 10 is reversed not only at intervals of a frame period, but data signals with mutually reversed polarities are provided to pixel formation portions adjacent in the extending direction of the data signal line SL, and data signals with mutually reversed polarities are also provided to pixel formation portions adjacent in the extending direction of the scanning signal line GL, namely, a dot-inversion driving system. However, the AC drive system of the liquid crystal display device according to the present invention is not limited to the dot-inversion driving system, and for example, a system may be employed where the display panel 100 is driven such that data signals with mutually reversed polarities are provided to pixel formation portions adjacent in the extending direction of the data signal line SL, and data signals with the same polarity are provided to pixel formation portions adjacent in the extending direction of the scanning signal line GL, namely, a line-inversion driving system.

<1.3 Sample-and-Hold Circuit for Data-Signal-Line Drive>

Figure 6:
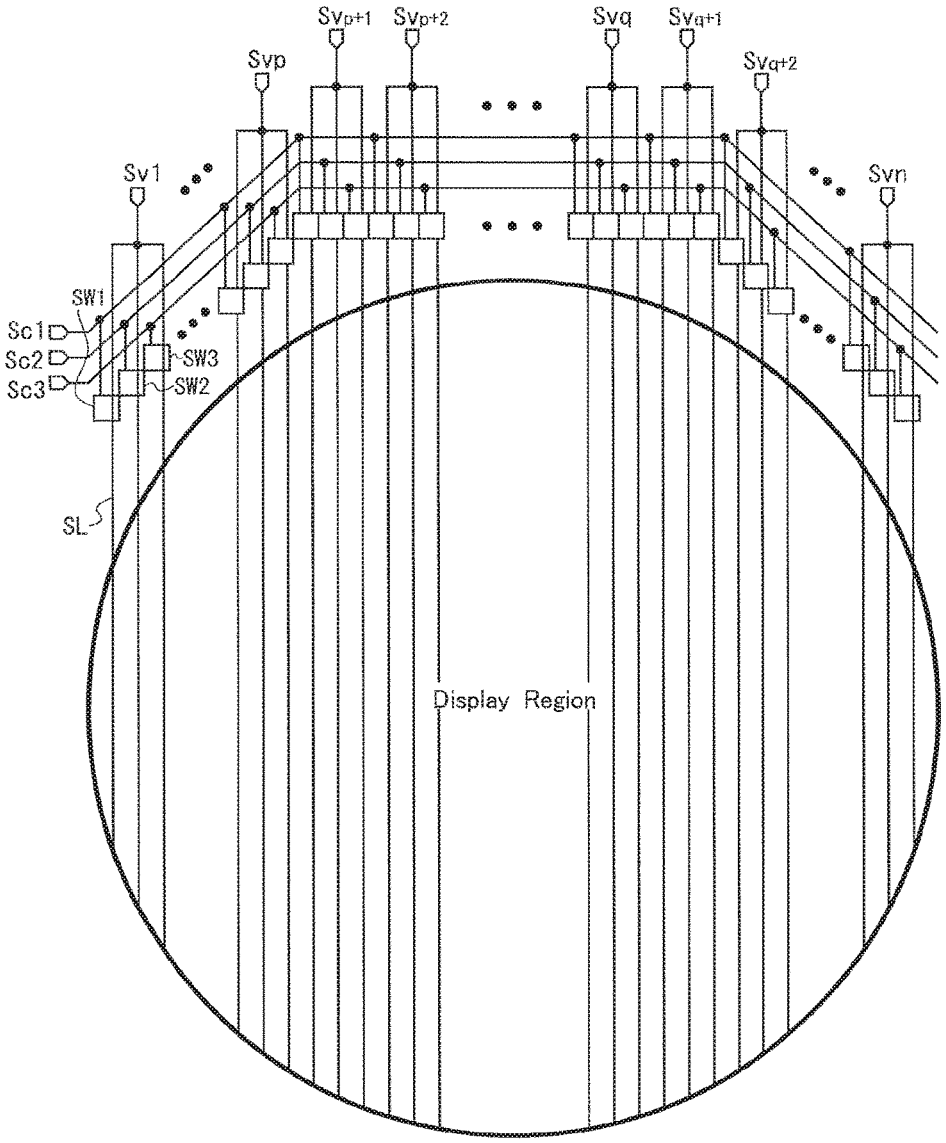
FIG. 6 is a diagram showing a placement example of the demultiplex circuit in the first embodiment.
Figure 7:
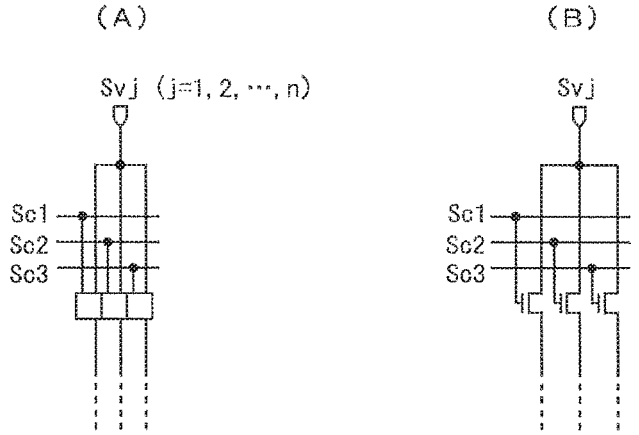
FIGS. 7(A) and 7(B) are diagrams for describing a method for representing one demultiplexer in the demultiplex circuit in the first embodiment.

As shown in FIG. 1, in the present embodiment, since the display unit 120 is circular, the data signal line SLj (j=1 to 3n) is the longest at the center of the display unit 120 and becomes shorter as approaching the ends thereof, differently from the case of a rectangular display unit with the data signal lines SL1 to SL3*n* having the same length. Such a difference in length among the data signal lines is larger when the TFTs (Nch transistors) as the connection control switching elements in the demultiplex circuit 320 are disposed at the outer edge of the display unit 120 along the display unit 120, as shown in FIG. 6. With the placement configuration as shown in FIG. 6, the size of the entire device can be reduced by forming the shape of the display device in accordance with the shape of the display unit 120. For the sake of convenience, in FIG. 6, the representation of the circuit is slightly different from the representation of FIG. 1, and a circuit shown in FIG. 7(B) is represented by a circuit diagram of FIG. 7(A)

In the present embodiment having the circular display unit 120 as shown in FIG. 1 or 6, the data signal line capacitance Csl is the largest at the center of the region of the display unit 120 (hereinafter referred to as "display region"), namely in the portion where the data signal line SL is the longest, and is the smallest at both ends of the display region, namely in the portion where the data signal line SL is the shortest.

When it is assumed here that a change is made instantly from the H-level connection control voltage VCH as the on-voltage to the L-level connection control voltage VCL as the off-voltage in the fall of the connection switch control signal Sck (k=1, 2, 3), the voltage Vsl of the data signal line SLj connected to the TFT (Nch transistor) as the connection control switching element decreases due to the parasitic capacitance Cgd between the gate terminal and the drain terminal of the TFT. The decrease amount ΔVsl of the data signal line voltage Vsl (hereinafter referred to as "signal line voltage decrease amount) becomes smaller as the capacitance Csl of the data signal line SLj becomes larger. Thus, when the display region is circular as in the present embodiment, this voltage decrease amount ΔVsl greatly varies depending on the position in the display region. As a result, even when the same pixel data is written into each pixel formation portion 10, a voltage (pixel voltage) held in (the pixel capacitance Cp of) the pixel formation portion 10 varies depending on the position in the display region, to cause occurrence of the display unevenness. The present embodiment has a configuration for preventing degradation of the display quality which is caused by the fact that the length or the capacitance Csl of the data signal line SL varies depending on the position in the display region. This point will be described in detail below.

Figure 8:
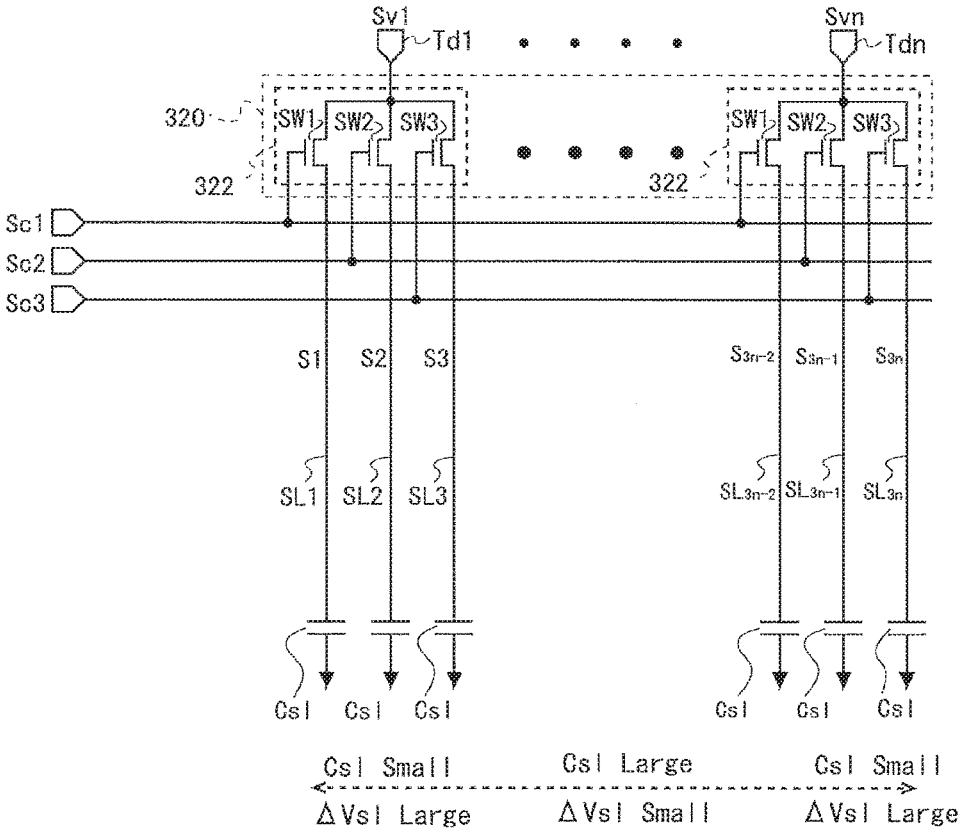
FIG. 8 is a circuit diagram showing a configuration for sampling and holding of a video signal by the demultiplex circuit in the first embodiment.

FIG. 8 is a circuit diagram showing a configuration for sampling and holding of the video signal Svi by the demultiplex circuit 320 in the present embodiment. As shown in FIG. 8, in the present embodiment, each demultiplexer 322 in the demultiplex circuit 320 includes Nch transistors SW1 to SW3 as three analog switches (TFTs as the connection control switching elements). First conductive terminals of the Nch transistors SW1 to SW3 in each demultiplexer are connected with one another and provided with the video signal Svi, and second conductive terminals of these Nch transistors SW1 to SW3 are respectively connected to the data signal lines SL3*i*-2, SL3*i*-1, SL3*i* (i=1 to n). The first to third connection switch control signals Sc1 to Sc3 are respectively provided to gate terminals as control terminals of the Nch transistors SW1 to SW3 in each demultiplexer 322. Which is taken as a drain terminal (or a source terminal) between the first and second conductive terminals of each of the Nch transistors SW1 to SW3 depends on a direction of a current flowing through each of the Nch transistors SW1 to SW3, but in the following, a description will be given assuming that the first conductive terminal is the source terminal and the second conductive terminal is the drain terminal for the sake of convenience.

Each Nch transistor SWk of each demultiplexer 322 in the demultiplex circuit 320 as the sampling circuit has the parasitic capacitance Cgd that is formed between the gate terminal and the drain terminal (second conductive terminal). Hence, the voltage change in the connection switch control signal Sck at the time of the Nch transistor SWk changing from the on-state to the off-state in the i-th demultiplexer 322 has an influence on the voltage of the data signal line SL3 (i−1)+k via the parasitic capacitance Cgd (i=1 to n; k=1, 2, 3). As a result, the voltage of the data signal line SL3(*i*−1)+k, namely the voltage Vsl of the data signal S3(*i*−1)+k, immediately after turning-off of the Nch transistor SWk, becomes lower than the voltage of the video signal Svi that is provided to the data signal S3(*i*−1)+k when the Nch transistor SWk is in the on-state. That is, the data signal line voltage Vsl obtained by sampling the video signal Svi with the connection switch control signal Sck becomes lower than the original voltage (Svi) due to the parasitic capacitance Cgd. In the present embodiment, for reducing this voltage decrease, it is configured such that the change from the on-voltage to the off-voltage, namely the change from the H-level connection control voltage VCH to the L-level connection control voltage VCL, at the time of turning off the Nch transistor SWk is made through the period TCI for the intermediate level (VCI) (see FIG. 4).

Hereinafter, with reference to FIGS. 9 to 11, a more detailed description will be given of operation for reducing a decrease in data signal line voltage Vsl at the time of sampling the video signal Svi as described above, by taking sampling of the first video signal Sv1 as an example.

Figure 9:
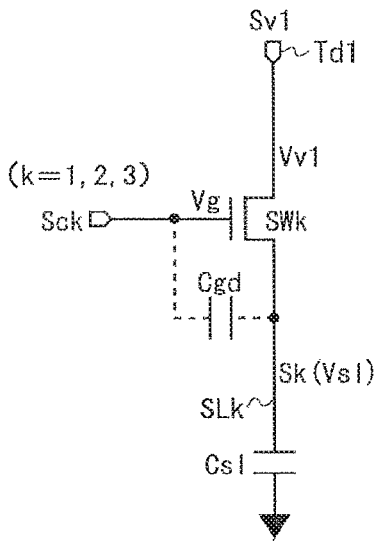
FIG. 9 is a circuit diagram showing a configuration of a unit sample-and-hold circuit for data-signal-line drive in the first embodiment.

FIG. 9 is a circuit diagram showing a configuration of a portion corresponding to a circuit for sampling the video signal Sv1 and providing it to one data signal line SLk to be held, namely a unit sample-and-hold circuit (hereinafter referred to as "unit sample-and-hold circuit for data-signal-line drive", or simply "unit sample-and-hold circuit") in the present embodiment. The configuration of the unit sample-and-hold circuit for data-signal-line drive in the conventional display device where the SSD system or the like is employed (hereinafter referred to as "conventional unit sample-and-hold circuit") is also the same as the configuration of FIG. 9. Hence, the same reference numeral and symbol are provided to the corresponding portion and signal in these unit sample-and-hold circuits.

Figure 10:
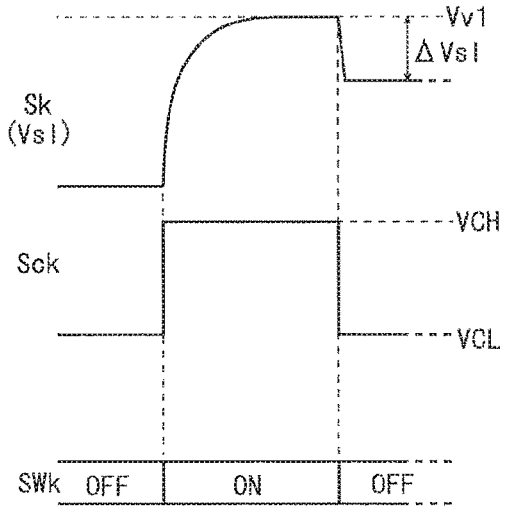
FIG. 10 is a signal waveform diagram showing operation of a conventional unit sample-and-hold circuit.
Figure 11:
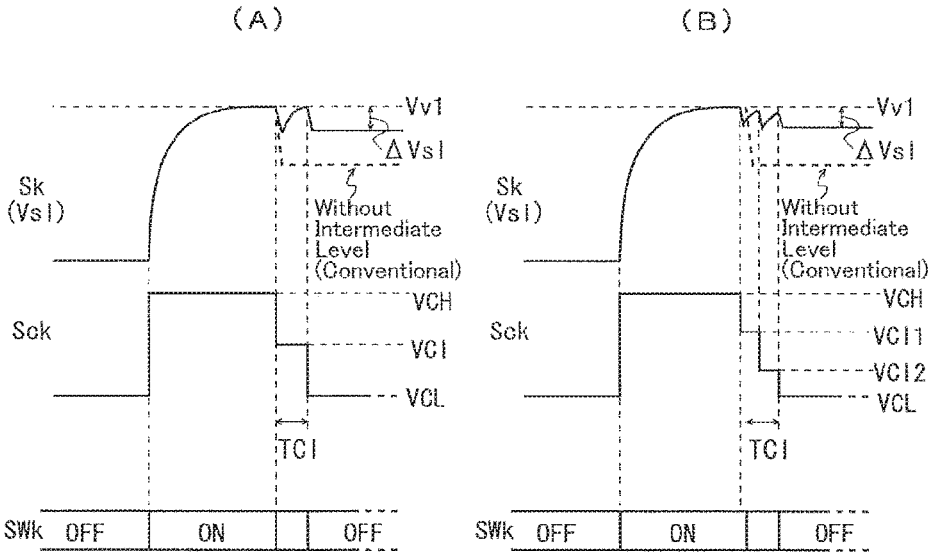
FIGS. 11(A) and 11(B) are signal waveform diagrams showing operation of the unit sample-and-hold circuit in the first embodiment.

FIG. 10 is a signal waveform diagram showing operation of the conventional unit sample-and-hold circuit, and FIG. 11 is a signal waveform diagram showing operation of the unit sample-and-hold circuit in the present embodiment.

As shown in FIG. 10, in the conventional unit sample-and-hold circuit, at the time of turning off the Nch transistor SWk, the voltage of the connection switch control signal Sck, namely the voltage Vg of the gate terminal of the Nch transistor SWk, immediately changes from the H-level connection control voltage VCH to the L-level connection control voltage VCL as described above, and this change has an influence on the voltage of the data signal line SLk via the parasitic capacitance Cgd between the gate terminal and the drain terminal. As a result, the voltage Vsl of the data signal line SLk, namely a voltage of a data signal Sk, becomes lower than the voltage of the video signal Svi that is provided to the data signal line SLk when the Nch transistor SWk is in the on-state. That is, the data signal line voltage Vsl obtained by sampling the video signal Svi with the connection switch control signal Sck becomes lower than the original voltage (Vvi) due to the parasitic capacitance Cgd. The decrease amount ΔVsl of the data signal line voltage Vsl at this time is expressed by the following formula, assuming that the voltage Vg of the connection switch control signal Sck instantly changes from the H-level connection control voltage VCH to the L-level connection control voltage VCL:

$$\Delta Vsl=\{Cgd/(Csl+Cgd)\}(VCH-VCL) \quad (3)$$

where "Csl" is a capacitance of the data signal line SLk.

As shown in FIG. 11(A), in the unit sample-and-hold circuit in the present embodiment, differently from the above conventional unit sample-and-hold circuit, at the time of turning off the Nch transistor SWk, the voltage Vg of the connection switch control signal Sck (the voltage of the gate terminal of the Nch transistor SWk) changes from the H-level connection control voltage VCH to the L-level connection control voltage VCL through the period TCI for the intermediate level connection control voltage VCI (hereinafter referred to as "connection control intermediate level period"). That is, in the process of the voltage Vg of the connection switch control signal Sck changing from the H-level connection control voltage VCH to the L-level connection control voltage VCL, namely the process from the on-voltage to the off-voltage (off-shift process), first, the data signal line voltage Vsl decreases by the change from the H-level connection control voltage VCH to the intermediate level connection control voltage VCI. However, the voltage Vg of the connection switch control signal Sck is then kept at the intermediate level connection control voltage VCI just during the connection control intermediate level period TCI. In this connection control intermediate level period TCI, since the Nch transistor SWk is not completely in the off-state (since it is in an intermediate state which can be said to be neither the on-state nor the off-state), charges transfer from a terminal Td1 of the data signal line drive circuit 300 which outputs the video signal Sv1 to the data signal line SLk via the Nch transistor SWk. Thereby, the data signal line voltage Vsl increases to the vicinity of the voltage Vv1 of the video signal Sv1. When this connection control intermediate level period TCI is ended, the voltage Vg of the connection switch control signal Sck changes from the intermediate level connection control voltage VCI to the L-level connection control voltage VCL, and by this change, the data signal line voltage Vsl decreases again. As above, the data signal line voltage Vsl is lower than the voltage Vv1 of the video signal Sv1 at the point of time when the voltage Vg of the connection switch control signal Sck reaches the L-level connection control voltage VCL as the off-voltage, but the signal line voltage decrease amount ΔVsl is reduced more than the signal line voltage decrease amount ΔVsl in the conventional unit sample-and-hold circuit due to transfer of the charges to the data signal line SLk in the connection control intermediate level period TCI (see FIG. 11(A) and FIG. 10).

As described above, according to the present embodiment where the signal Sck with the waveform as shown in FIG. 11(A) is used as the connection switch control signal Sck of the demultiplex circuit 320, the signal line voltage decrease amount ΔVsl due to the parasitic capacitance Cgd is reduced in the off-shift process of the Nch transistor SWk. When the conventional unit sample-and-hold circuit is used in the display device with the circular display unit 120 as shown in FIG. 1, the data signal line capacitance Csl varies depending on the data signal line SL, and thereby the signal line voltage decrease amount ΔVsl also varies depending on the data signal line SLk (see FIG. 8). In contrast, according to the present embodiment, the signal line voltage decrease amount ΔVsl is reduced, and thereby the difference in signal line voltage decrease amount ΔVsl due to the data signal line SLj is also reduced. Accordingly, even when the lengths and the capacitances Csl of the data signal lines SL1 to SL3*n* are different from one another as the circular (more generally, non-rectangular) display unit 120 is provided, a favorable display with reduced display unevenness can be produced.

<1.4 Other Operation Examples of Unit Sample-and-Hold Circuit for Data-Signal-Line Drive>

As described above, in the present embodiment, the signal with the waveform as shown in FIG. 11(A) is generated as the connection switch control signal Sck of the demultiplex circuit 320 in the connection control circuit 50 (FIG. 3), and the intermediate level period TCI is provided in the off-shift process of the connection control switching element SWk (FIG. 9). The number of intermediate levels provided in the off-shift process is not limited to one, but a plurality of intermediate levels may be provided. For example, as shown in FIG. 11(B), two intermediate levels VCI1, VCI2 may be provided in the off-shift process, and the voltage of the connection switch control signal Sck may change from the on-voltage (H-level connection control voltage VCH) to the off-voltage (L-level connection control voltage VCL) in a stepwise manner sequentially through two periods of the intermediate levels VCI1, VCI2.

Here, the intermediate level period TCI is the time for reducing or compensating a decrease in the data signal line voltage Vsl due to the voltage change in the connection switch control signal Sck by charging the parasitic capacitance Cgd and the data signal line capacitance Csl via the Nch transistor (connection control switching element) SWk, and with the formula (3) above taken into consideration, the intermediate level period TCI is predetermined based on the time required for charging or discharging of the parasitic capacitance Cgd via the Nch transistor SWk. This intermediate level period TCI is preferably long from the viewpoint of reducing the signal line voltage decrease amount ΔVsl, but when the intermediate level period TCI is made longer, the time for charging the data signal line SLk by the video signal Svi becomes shorter. Further, what value is preferred as the voltage value of the intermediate level depends on characteristics of the Nch transistor SWk as the connection control switching element. Therefore, for the set number and the voltage value of the intermediate level as well as the length of the intermediate level period, appropriate values are determined from the plurality of viewpoints described above based on the specification (resolution, size, etc.) of the display unit 120, and electrical characteristics (characteristics of the parasitic capacitance Cgd, the data signal line capacitance Csl, the Nch transistor SWk, etc.). Specifically, based on a result of an experiment or a computer simulation on the unit sample-and-hold circuit shown in FIG. 9, it is possible to obtain appropriate values for the set number and the voltage value of the intermediate level as well as the length of the intermediate level period.

Further, instead of providing the intermediate level and generating the connection switch control signal Sck that changes from the on-voltage to the off-voltage in a stepwise manner as described above, it may be configured such that the connection switch control signal Sck is generated in the connection control circuit 50 (FIG. 3) so as to change from the on-voltage (H-level connection control voltage VCH) to the off-voltage (L-level connection control voltage VCL) in a continuous manner (typically, change monotonously and smoothly) in the predetermined intermediate level period TCI, as shown in FIG. 12(A).

Further, by focusing on the fact that the current stops flowing in the Nch transistor SWk when the connection switch control signal Sck comes near the L-level connection control voltage VCL as the off-voltage, it may be configured such that the connection switch control signal Sck with a waveform as shown in FIG. 12(B) is generated in the connection control circuit 50 (FIG. 3). That is, it may be configured such that an intermediate L-level connection control voltage VCL2 corresponding to a threshold voltage of the Nch transistor SWk is set (VCL2>VCL), and the connection switch control signal Sck is generated so as to change from the on-voltage (H-level connection control voltage VCH) to the intermediate L-level connection control voltage VCL2 in a continuous manner (typically, change monotonously and smoothly) in the predetermined intermediate level period TCI, and then immediately changes to the off-voltage (L-level connection control voltage VCL).

Also in the configuration where the connection switch control signal Sck with each of the waveforms shown in FIGS. 12(A) and 12(B), in the intermediate level period TCI in the off-shift process of the Nch transistor SWk as the connection control switching element, charges transfer from a terminal Td1 of the data signal line drive circuit 300 which outputs the video signal Sv1 to the data signal line SLk via the Nch transistor SWk. Thereby, as shown in FIGS. 12(A) and 12(B), the signal line voltage decrease amount ΔVsl at the time of turning off of the Nch transistor SWk is reduced as compared with the conventional case. As a result, similarly to the case where the voltage of the connection switch control signal Sck changes in a stepwise manner in the off-shift process as shown in FIG. 11, even when the length and the capacitance Csl of the data signal line SL vary depending on the position in the display region due to provision of the circular (more generally, non-rectangular) display unit 120, it is possible to produce a favorable display with reduced display unevenness.

<1.5 Sample-and-Hold Circuit for Writing Pixel Data>

As shown in FIG. 1, in the present embodiment, since the display unit 120 is circular, not only the lengths of the data signal lines SL1 to SL3*n* but also the lengths of the scanning signal lines GL1 to GLm are different from one another, and the scanning signal line GL is the longest at the center of the display unit 120 and becomes shorter as approaching the ends thereof.

Figure 13:
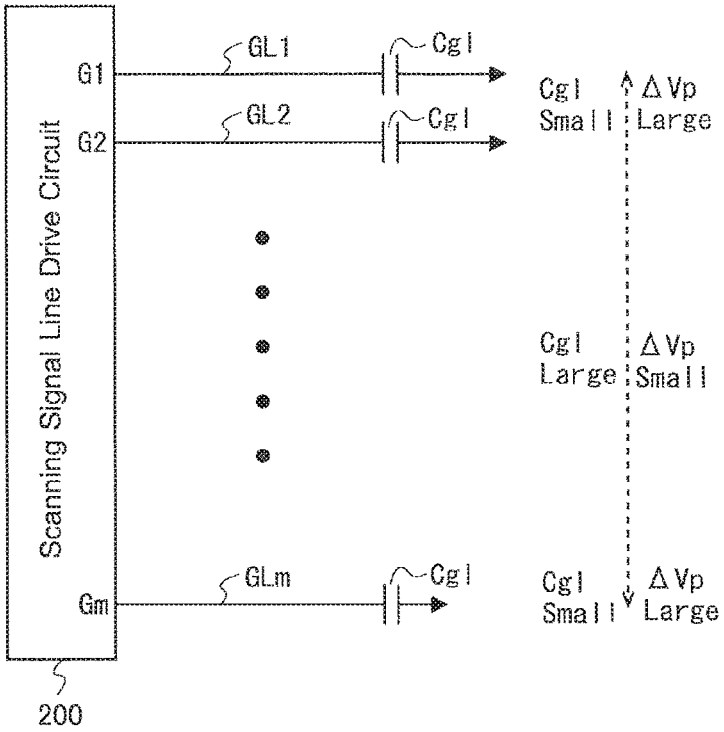
FIG. 13 is a diagram for describing a capacitance of a scanning signal line in the first embodiment.

FIG. 13 is a diagram for describing a capacitance of each of the scanning signal lines GL1 to GLm that are driven for writing into each pixel formation portion 10 the pixel data (pixel voltage) indicated by the data signals S1 to S3*n* in the present embodiment. A capacitance is formed between each scanning signal line GLi and the other electrodes (the common electrode Ec, an electrode constituting the data signal line SL) (hereinafter, this capacitance is referred to as "scanning signal line capacitance Cgl"). In the present embodiment having the circular display unit as shown in FIG. 1, this scanning signal line capacitance Cgl varies depending on the length of the scanning signal line GL, and the scanning signal line capacitance Cgl is the largest at the center of the display region, namely in the portion where the scanning signal line GL is the longest, and is the smallest at both ends of the display region, namely in the portion where the scanning signal line GL is the shortest, as shown in FIG. 13.

Figure 14:
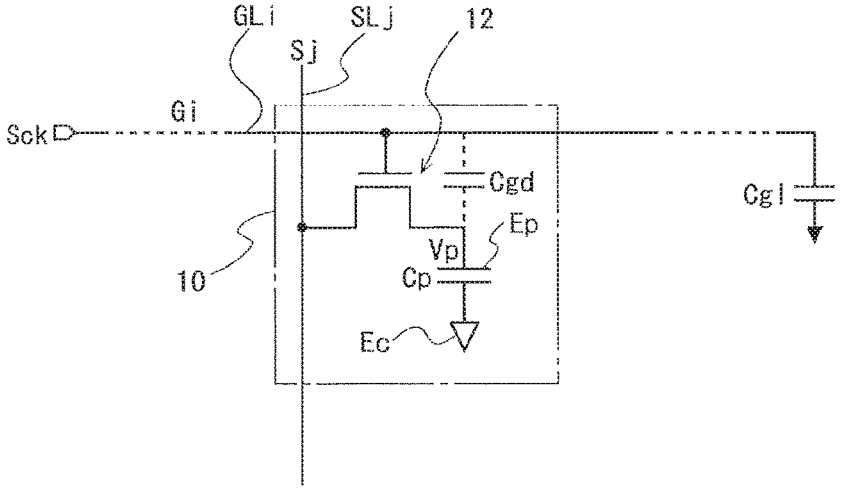
FIG. 14 is a circuit diagram showing a configuration of a pixel data sample-and-hold circuit in the first embodiment.

FIG. 14 is a circuit diagram showing a sample-and-hold circuit for writing pixel data indicated by the data signal Sj into the pixel formation portion 10 connected to the scanning signal line GLi (i=1 to m, j=1 to 3n) in the present embodiment. In this pixel formation portion 10, when the scanning signal Gi to be applied to the scanning signal line GLi become active (H-level gate voltage VGH), the TFT 12 (Nch transistor) as the pixel switching element enters the on-state, and the data signal Sj on the data signal line SLj is provided to the pixel capacitance Cp via the TFT 12. Thereby, the pixel capacitance Cp is charged by the data signal Sj, and the voltage of the pixel electrode Ep, namely the pixel voltage Vp, becomes equal to the voltage Vsl of the data signal line SLj. At this time, the parasitic capacitance Cgd between the gate terminal and the drain terminal of the TFT 12 is also charged. The scanning signal Gi is kept in the active state (H-level gate voltage VGH) just during a predetermined period which is about one horizontal period, and then becomes non-active (L-level gate voltage VGL). Hence, the pixel voltage Vp is held in the pixel capacitance Cp until the scanning signal Gi becomes active next. In this manner, the data signal line voltage Vsl being the voltage of the data signal Si is written and held in the pixel formation portion 10 as the pixel data. By such operation, the pixel formation portion 10 constitutes a sample-and-hold circuit (hereinafter referred to as "pixel data sample-and-hold circuit") where the TFT 12 is a sampling switch and the pixel capacitance Cp is a hold capacitance.

Figure 15:
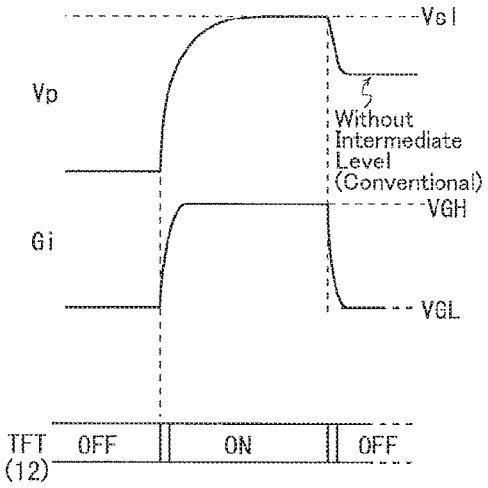
FIG. 15 is a signal waveform diagram showing operation of a pixel data sample-and-hold circuit of a conventional pixel formation portion.

The conventional pixel formation portion also has an electrical configuration similar to the sample-and-hold circuit of the pixel data shown in FIG. 14, and after the data signal line voltage Vsl is written as pixel data into the pixel formation portion, the pixel voltage Vp held in the pixel capacitance Cp decreases when the scanning signal Gi becomes non-active. That is, in the conventional pixel formation portion, when the TFT 12 being the Nch transistor is turned off by making the scanning signal Gi non-active, as shown in FIG. 15, the voltage of the scanning signal Gi, namely the voltage of the gate terminal of the TFT 12, immediately changes from the H-level gate voltage VGH to the L-level gate voltage VGL, and has an influence on the voltage of the pixel electrode Ep (pixel voltage) via the parasitic capacitance Cgd. As a result, the pixel voltage Vp becomes lower than the data signal line voltage Vsl that is provided to the pixel electrode Ep when the TFT 12 is in the on-state. That is, the pixel voltage Vp obtained by sampling the data signal Si by the scanning signal Gi becomes lower than the original voltage (Vsl) due to the parasitic capacitance Cgd. A decrease amount ΔVp of the pixel voltage Vp (hereinafter referred to as "pixel voltage decrease amount") is expressed by the following formula, assuming that the voltage of the scanning signal Gi instantly changes from the H-level gate voltage VGH to the L-level gate voltage VGL:

$$\Delta Vp=\{Cgd/(Cp+Cgd)\}(VGH-VGL) \quad (4)$$

As shown in FIG. 1, in the present embodiment, the scanning signal line capacitance Cgl varies depending on the length of the scanning signal line GLi since the display unit 120 is circular, and the scanning signal line capacitance Cgl is the largest at the center where the scanning signal line GL is the longest, and is the smallest at the ends where the scanning signal line GL is the shortest, as described above (see FIG. 13). When it is assumed here that the scanning signal Gi is a voltage signal with a rectangular wave as in the conventional case, its waveform becomes dull in accordance with the scanning signal line capacitance Cgl. That is, the dullness of the waveform of the scanning signal Gi that is the rectangular voltage signal becomes larger as the capacitance Cgl of the scanning signal line GLi becomes larger. When the dullness of the waveform of the scanning signal Gi becomes larger, in the fall of the scanning signal Gi (in the off-shift process of the TFT 12), an amount of charges that transfer from the data signal line SLj to the pixel electrode Ep via the TFT 12 as the pixel switching element becomes larger. Therefore, the larger the dullness of the waveform of the scanning signal Gi, the smaller the pixel voltage decrease amount ΔVp (>0). As shown in FIG. 13, the pixel voltage decrease amount ΔVp is the smallest at the center of the display region where the scanning signal line GL is the longest, and is the largest at both ends of the display region where the scanning signal line GL is the shortest.

In the pixel formation portion 10 as the sample-and-hold circuit of the pixel data in the present embodiment, differently from the conventional pixel formation portion, at the time of turning off the TFT 12 that is the Nch transistor, the voltage Vg of the scanning signal Gi (the voltage of the gate terminal of the TFT 12) changes from the H-level gate voltage VGH to the L-level gate voltage VGL through the period TGI for the intermediate level gate voltage VGI (hereinafter referred to as "gate intermediate level period"). In the process for the voltage Vg of the scanning signal Gi to change from the H-level gate voltage VGH to the L-level gate voltage VGL, namely in the off-shift process, first, the pixel voltage Vp decreases by the change in the voltage Vg of the scanning signal Gi from the H-level gate voltage VGH to the intermediate level gate voltage VGI. However, the voltage Vg of the scanning signal Gi is then kept at the intermediate level gate voltage VGI just during the gate intermediate level period TGI. In this gate intermediate level period TGI, since the TFT 12 is not completely in the off-state (since it is in an intermediate state which can be said to be neither the on-state nor the off-state), charges transfer from the data signal line SLj to the pixel electrode Ep via the TFT 12. Accordingly, the pixel voltage Vp increases to the vicinity of the data signal line voltage Vsl that has been written as the pixel data. When this gate intermediate level period TGI is ended, the voltage Vg of the scanning signal Gi changes from the intermediate level gate voltage VGI to the L-level gate voltage VGL, and by this change, the pixel voltage Vp decreases again. At the point of time when the voltage Vg of the scanning signal Gi reaches the L-level gate voltage VGL as the off-voltage in the above manner, the pixel voltage Vp has become lower than the data signal line voltage Vsl, but as shown in FIG. 16(A), the pixel voltage decrease amount ΔVp has been reduced more than the pixel voltage decrease amount ΔVp in the conventional pixel formation portion due to transfer of the charges to the pixel electrode Ep in the gate intermediate level period TGI.

As described above, according to the present embodiment in which the voltage Vg with the waveform as shown in FIG. 16(A) is used as the scanning signal Gi, in the off-shift process of the TFT 12 as the pixel switching element, the pixel voltage decrease amount ΔVp generated due to the parasitic capacitance Cgd is reduced. Further, in the display device with the circular display unit 120 as shown in FIG. 1, although the scanning signal line capacitance Cgl varies depending on the scanning signal line GLj (see FIG. 13), according to the present embodiment as above, the difference in the signal line voltage decrease amount ΔVsl among the scanning signal lines GL is reduced along with reduction in the pixel voltage decrease amount ΔVp. Accordingly, even when the lengths and the capacitances Cgl of the scanning signal lines GL1 to GLm are different from one another due to provision of the circular (more generally, non-rectangular) display unit 120, a favorable display with reduced display unevenness can be produced.

<1.6 Other Operation Examples of Sample-and-Hold Circuit of Pixel Data>

As described above, in the present embodiment, the voltage Vg with the waveform as shown in FIG. 16(A) as the scanning signal Gi is generated in the scanning signal line drive circuit 200 (FIG. 3), and the intermediate level period TGI is provided in the off-shift process of the TFT 12 (FIG. 14) as the pixel switching element. The number of intermediate levels provided in the off-shift process is not limited to one, but a plurality of intermediate levels may be provided. For example, as shown in FIG. 16(B), two intermediate levels VGI1, VGI2 are provided in the off-shift process, and the voltage Vg of the scanning signal Gi may change from the on-voltage (H-level gate voltage VGH) to the off-voltage (L-level gate voltage VGL) in a stepwise manner sequentially through two periods of intermediate levels VGI1, VGI2.

The intermediate level period TGI in the scanning signal Gi is the time for reducing or compensating a decrease in the pixel voltage Vp due to the voltage change in the scanning signal Gi by charging the parasitic capacitance Cgd and the pixel capacitance Cp via the TFT 12 (Nch transistor), and with the formula (4) above taken into consideration, the intermediate level period TGI is predetermined based on the time required for charging or discharging of the parasitic capacitance Cgd via the TFT 12. This intermediate level period TGI is preferably long from the viewpoint of reducing the pixel voltage decrease amount ΔVp, but when the intermediate level period TGI is made longer, the time for charging the pixel capacitance Cp by the data signal Sj (for writing the pixel data) becomes shorter. Further, what value is preferred as the voltage value of the intermediate level depends on characteristics of the TFT 12 as the pixel switching element. Therefore, for the set number and the voltage value of the intermediate level as well as the length of the intermediate level period, appropriate values are determined from the plurality of viewpoints described above based on the specification (resolution, size, etc.) of the display unit 120, and electrical characteristics (characteristics of the parasitic capacitance Cgd, the pixel capacitance Cp, the TFT 12, etc.). Specifically, based on a result of an experiment or a computer simulation on the sample-and-hold circuit (including the scanning signal line capacitance Cgl) of the pixel data shown in FIG. 14, it is possible to obtain appropriate values for the set number and the voltage value of the intermediate level as well as the length of the intermediate level period.

Although the length of the intermediate level period TGI in the present embodiment is the same for any scanning signal Gi in the present embodiment, the length of the intermediate level period TGI may be varied depending on the scanning signal Gi so as to make the pixel voltage decrease amount ΔVp uniform in the display unit 120. That is, the scanning signal line capacitance Cgl is the largest at the center of the display region, namely in the portion where the scanning signal line GL is the longest, and is the smallest at both ends of the display region, namely in the portion where the scanning signal line GL is the shortest (FIGS. 1, 13), and hence, the intermediate level period TGI in the scanning signal Gi shown in FIGS. 16 and 17 may be made the shortest in the scanning signal Gi to be supplied to the center of the display region, and may be made the longest in the scanning signal Gi to be supplied to both ends of the display region. With the configuration where the scanning signals G1 to Gm having the intermediate level period TGI as above are generated in the scanning signal line drive circuit 200, it is possible to more effectively reduce the display unevenness.

Figure 18:
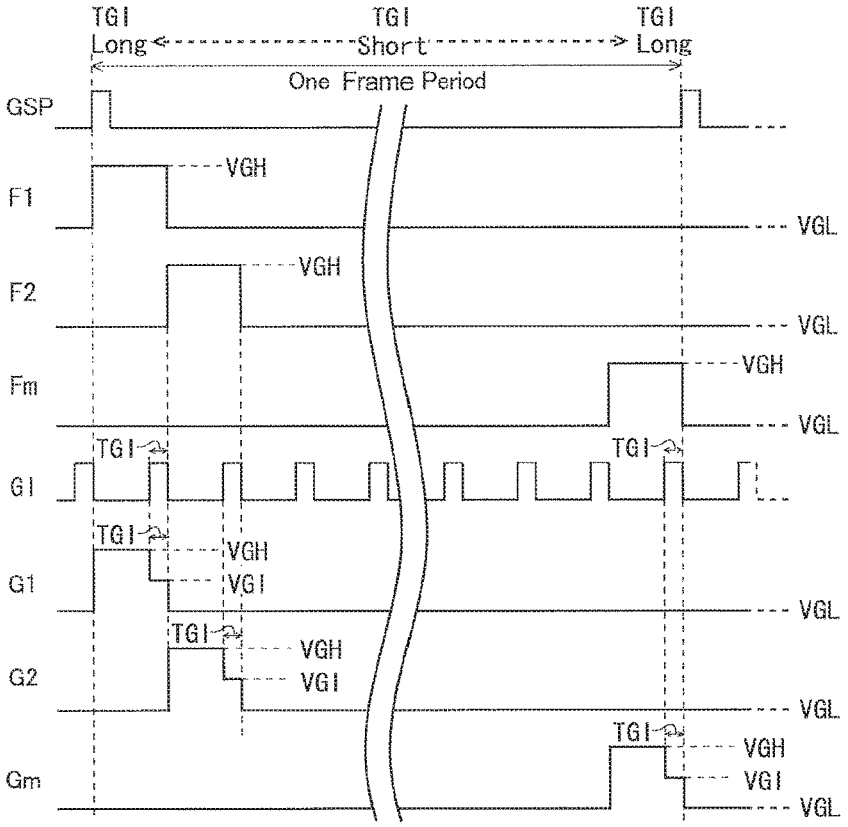
FIG. 18 is a signal waveform diagram for describing another configuration example for the pixel data sample-and-hold circuit in the first embodiment.

For example, in order to achieve the configuration for generating the scanning signal Gi with the waveform shown in FIG. 16(A), the gate intermediate-level period signal GI may be generated in each frame period such that, among pulses included in the gate intermediate-level period signal GI (a width of each of these pulses corresponds to the gate intermediate level period TGI), the width of the pulse closest to the center point of the frame period is the shortest, the pulse width becomes longer as the pulse goes away from the center point, and the pulse width closest to the start point or the end point of the frame period is the longest, as shown in FIG. 18. When such a gate intermediate-level period signal GI is generated in the display control circuit 400 and provided to the scanning signal line drive circuit 200, the scanning signal line drive circuit 200 generates the scanning signal Gi (i=1 to m) based on the gate intermediate-level period signal GI (see FIGS. 3 and 18).

Figure 16:
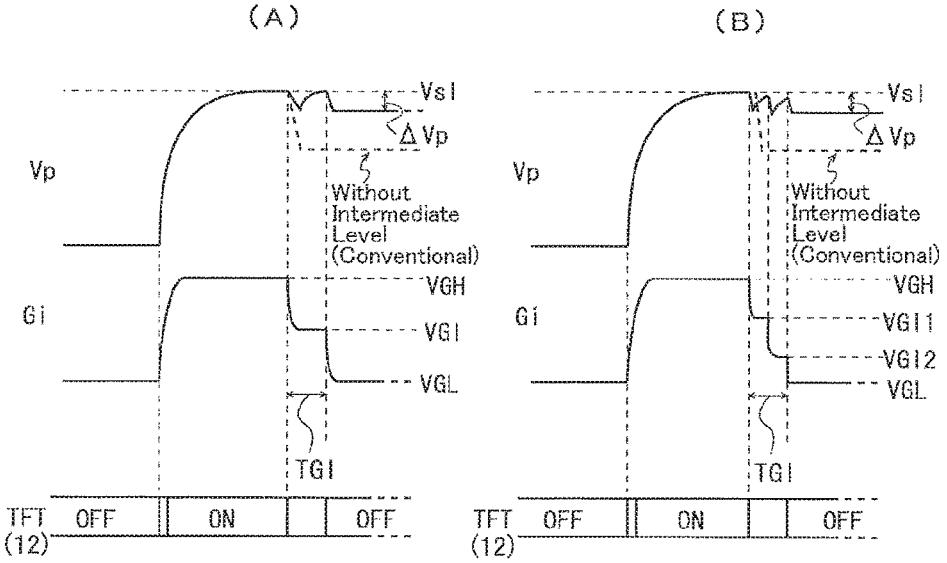
FIGS. 16(A) and 16(B) are signal waveform diagrams showing operation of the pixel data sample-and-hold circuit in the first embodiment.

Further, instead of providing the intermediate level and generating the scanning signal Gi that changes from the on-voltage to the off-voltage in a stepwise manner as shown in FIG. 16, it may be configured such that the scanning signal Gi is generated in the scanning signal line drive circuit 200 (FIG. 3) so as to change from the on-voltage (H-level gate voltage VGH) to the off-voltage (L-level gate voltage VGL) in a continuous manner (typically, change monotonously and smoothly) in the predetermined intermediate level period TGI, as shown in FIG. 17(A).

Further, by focusing on the fact that the current stops flowing in the TFT 12 as the Nch transistor when the scanning signal Gi comes near the L-level gate voltage VGL as the off-voltage, it may be configured such that the scanning signal Gi with a waveform as shown in FIG. 17(B) is generated in the scanning signal line drive circuit 200 (FIG. 3). That is, it may be configured such that an intermediate L-level gate voltage VGL2 corresponding to a threshold voltage of the TFT 12 is set (VGL2>VGL), and the scanning signal Gi is generated so as to change from the on-voltage (H-level gate voltage VGH) to the intermediate L-level gate voltage VGL2 in a continuous manner (typically, change monotonously and smoothly) in the predetermined intermediate level period TGI, and then immediately changes to the off-voltage (L-level gate voltage VGL).

Even with the configuration where the scanning signal Gi with the waveform of FIG. 17(A) or FIG. 17(B), charges transfer from the data signal line SLj to the pixel electrode Ep via the TFT 12 for the intermediate level period TGI in the off-shift process of the TFT 12 as the Nch transistor. Thereby, as shown in FIGS. 17(A) and 17(B), the pixel voltage decrease amount ΔVp at the time of turning off the TFT 12 is reduced as compared with the conventional case. As a result, similarly to the case where the voltage Vg of the scanning signal Gi changes in a stepwise manner in the off-shift process as shown in FIG. 16, even when the length and the capacitance Cgl of the scanning signal line GL vary depending on the position in the display region due to provision of the circular (more generally, non-rectangular) display unit 120, it is possible to produce a favorable display with reduced display unevenness.

<1.7 Effects>

Figure 12:
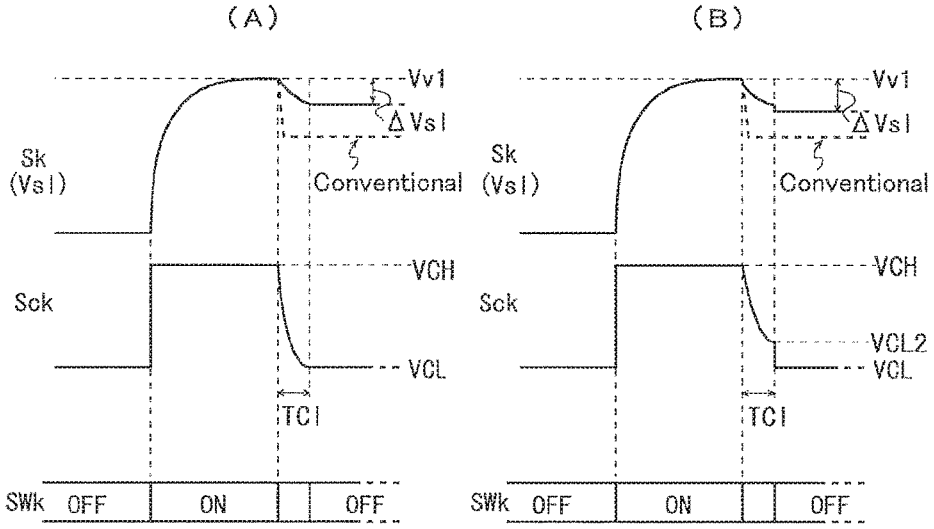
FIGS. 12(A) and 12(B) are signal waveform diagrams showing another operation example of the unit sample-and-hold circuit in the first embodiment.
Figure 17:
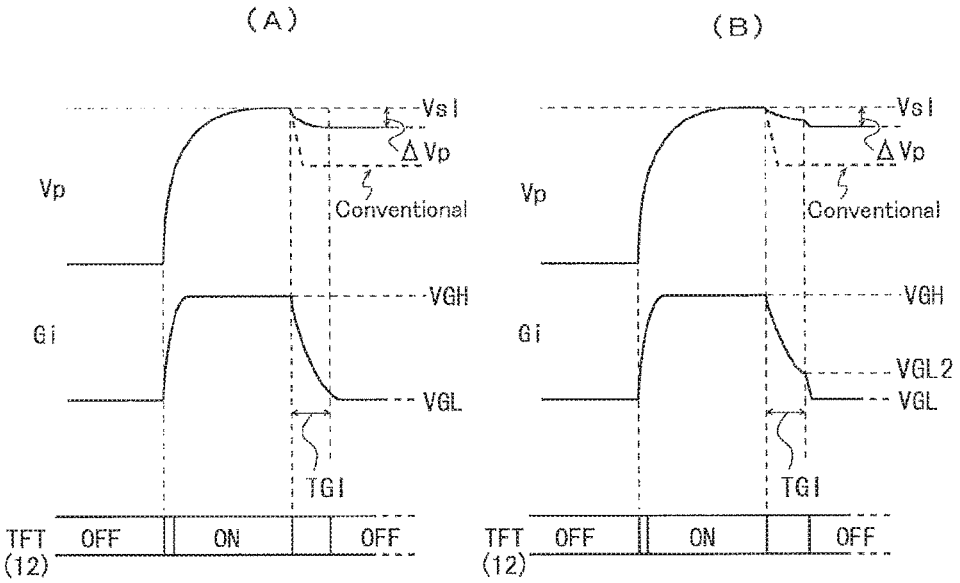
FIGS. 17(A) and 17(B) are signal waveform diagrams showing another operation example of the pixel data sample-and-hold circuit in the first embodiment.

As described above, in the present embodiment, as the connection switch control signal Sck of the demultiplex circuit 320, namely the connection switch control signal Sck of the sample-and-hold circuit (FIGS. 8, 9) for data-signal-line drive, the signal with the waveform as shown in FIGS. 11 and 12 is generated in the connection control circuit 50 (FIG. 3), and the video signal Svi is sampled by the connection switch control signal Sck as above, and held on the data signal line SLj (data signal line capacitance Csl) as the data signal line voltage Vsl. Hence, the signal line voltage decrease amount ΔVsl generated due to the parasitic capacitance Cgd in the off-shift process of the Nch transistor SWk as the connection control switching element is reduced. Further, as the scanning signal Gi, the voltage Vg with the waveform as shown in FIGS. 16 and 17 is generated in the scanning signal line drive circuit 200 (FIG. 3), and the data signal line voltage Vsl is sampled by the scanning signal Gi as above and held in the pixel capacitance Cp as the pixel voltage Vp (FIG. 14). Hence, the pixel voltage decrease amount ΔVp generated due to the parasitic capacitance Cgd in the off-shift process of the TFT 12 as the pixel switching element is reduced. Therefore, even when the lengths of the data signal lines SL1 to SL3*n* (thus, data signal line capacitance Csl) are different from one another (FIG. 8) or the lengths of the scanning signal lines GL1 to GLm (thus, scanning signal line capacitance Cgl) are different from one another (FIG. 13) due to provision of the circular (more generally, non-rectangular) display unit 120 (FIG. 1), the difference in the signal line voltage decrease amount ΔVsl caused by the position in the display region is reduced, and the difference in the pixel voltage decrease amount ΔVp caused by the position in the display region is reduced. As a result, the pixel voltage decrease amounts ΔVp in the pixel formation portion 10 are made uniform in the entire display region, thereby enabling a favorable display with reduced display unevenness.

2. Modified Example

The present invention is not limited to the above embodiment, but a variety of modification can be made so long as not departing from the scope of the present invention.

For example, although the Nch transistor is used as the pixel switching element (TFT 12) in the pixel formation portion 10 and each of the connection control switching elements SW1 to SW3 in the demultiplex circuit 320 in the above embodiment (FIG. 2, FIG. 8), in place of this, one or both of the pixel switching element and the connection control switching element may be the Pch transistor, or may be an analog switch with a configuration where the Pch transistor and the Nch transistor are connected in parallel with each other (hereinafter referred to as "CMOS analog switch").

Figure 19:
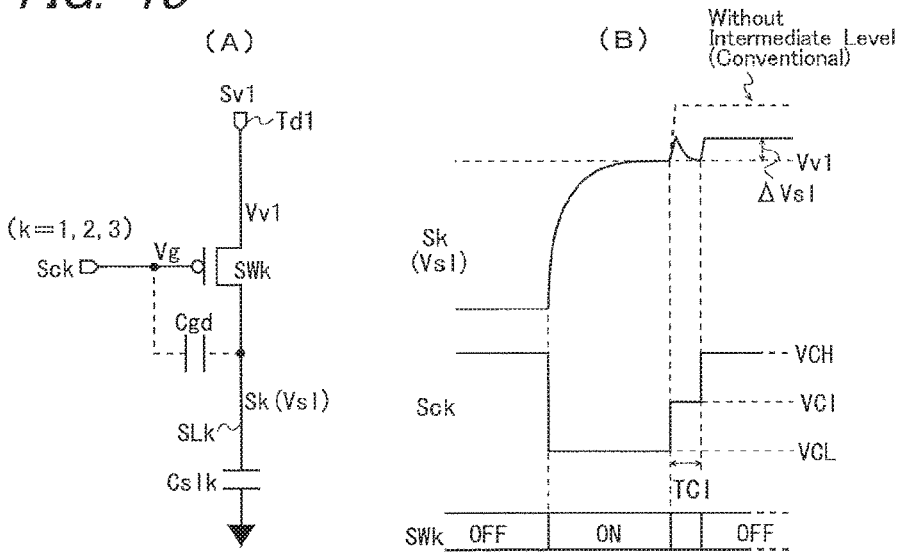
FIG. 19(A) is a circuit diagram and FIG. 19(B) is a signal waveform diagram for describing a unit sample-and-hold circuit for data-signal-line drive in a modified example of the first embodiment.

For example, when the Pch transistor is to be used as the connection control switching element SWk in place of the Nch transistor, the unit sample-and-hold circuit (FIG. 9) for data-signal-line drive which uses the demultiplex circuit 320 is formed as shown in FIG. 19(A), where in the connection switch control signal Sck, the L-level connection control voltage VCL corresponds to the on-voltage and the H-level connection control voltage VCH corresponds to the off-voltage. In this case, waveforms of the connection switch control signal Sck and the data signal line voltage Vsl are waveforms as shown in FIG. 19(B). The voltage change in the connection switch control signal Sck in the off-shift process of the connection control switching element SWk acts in a direction to decrease the data signal line voltage Vsl when the Nch transistor is used as in the above embodiment (FIGS. 10 to 12), whereas the voltage change acts in a direction to increase the data signal line voltage Vsl when the Pch transistor is used as in FIG. 19(A) (FIG. 19(B)). That is, a voltage variation of the data signal line SL which occurs due to the parasitic capacitance Cgd in the off-shift process of the connection control switching element SWk is a voltage decrease when the connection control switching element SWk is the Nch transistor, and is a voltage increase when the connection control switching element SWk is the Pch transistor. In such a manner, even when the Pch transistor is used as the connection control switching element SWk, a similar effect to that of the above embodiment can be obtained.

Further, for example when a CMOS switch is used in place of the Nch transistor as the connection control switching element SWk, gate terminals of the Nch transistor and the Pch transistor which constitute the CMOS switch are respectively provided with a connection switch control signal Sck with the same waveform as that of the connection switch control signal Sck in the above embodiment and a reversed connection switch control signal SckR with a waveform obtained by reversing the waveform of the connection switch control signal Sck. In such a manner, even when the CMOS switch is used as the connection control switching element SWk, a similar effect to that of the above embodiment can be obtained.

Although the data signal line SL or the scanning signal line GL is the longest at the center of the display region (the region of the display unit 120) and the shortest at both ends thereof since the display region is circular in the above embodiment, the present invention is applicable to an active matrix display device where the display unit 120 is in a non-rectangular shape other than a circular shape and at least two data signal lines SLi1, SLi2 have different lengths or at least two scanning signal lines GLj1, GLj2 have different lengths.

Further, when the liquid crystal display device according to the present embodiment is a display device for displaying a color image based on three primary colors of red (R), green (G), and blue (B), for example, it is configured such that a data signal line SL3*i*-2 that transmits a data signal for displaying a red pixel, a data signal line SL3*i*-1 that transmits a data signal for displaying a green pixel, and a data signal line SL3*i* that transmits a data signal for displaying a blue pixel are taken as one group, and the respective data signal lines SL3*i*-2, SL3*i*-1, SL3*i* (i=1 to n) are disposed in the display unit 120. In this case, for favorably displaying a white color, the three data signal lines SL3*i*-2, SL3*i*-1, SL3*i* in the same group preferably have the same length.

In the above embodiment, the waveform of the connection switch control signal Sck provided to the sample-and-hold circuit for data-signal-line drive has the characteristics described above (FIGS. 9, 11, 12) and the waveform of the scanning signal Gi provided to the pixel data sample-and-hold circuit has the characteristics described above (FIGS. 14, 16, 17), but it may be configured such that the waveforms have only one of these characteristics.

3. Other Embodiments

Although the above first embodiment is obtained by applying the present invention to the liquid crystal display device of the SSD system, the present invention is not limited thereto, but is also applicable to a liquid crystal display device other than the SSD system or a display device other than a liquid crystal display device, so long as it is a display device where a voltage of an analog video signal is sampled and held on a data signal line and the held voltage on the data signal line is written into a pixel formation portion of a display unit.

For example, the present invention is also applicable to a display device of a dot sequential driving system. FIG. 20(A) is a diagram showing a configuration of a data signal line drive circuit in the display device of the dot sequential driving system, to which the present invention is applicable, along with a detailed configuration of an analog switch unit. This display device of the dot sequential driving system is substantially similar to the display device in the above first embodiment (see FIG. 1) except for a configuration concerning the drive of data signal lines. Hence, the same or corresponding portion is provided with the same reference numeral, and the detailed description thereof is omitted.

This data signal line drive circuit is provided with a sampling pulse generation circuit 510, a plurality of analog switch units 521, 522, . . . , 52N respectively corresponding to a plurality of data signal lines SL1, SL2, . . . , SLN, and a video line 54 connected with each of the plurality of data signal lines SL1, SL2, . . . , SLN via at least one of the plurality of analog switch units 521, 522, . . . , 52N. A start pulse signal SSP which come to the H-level in each horizontal period and a clock signal SCK are inputted into the sampling pulse generation circuit 510, and an analog video signal Video is provided to the video line 54.

The sampling pulse generation circuit 510 includes a shift register that sequentially shifts the start pulse SSP from an input end to an output end during one horizontal period in accordance with the clock signal SCK, and outputs a plurality of sampling signals SAM1, SAM2, . . . , SAMN, which sequentially become active in each predetermined time, based on an output signal of each stage of this shift register. These plurality of sampling signals SAM1, SAM2, . . . , SAMN respectively correspond to the above plurality of data signal lines SL1, SL2, . . . , SLN. Each sampling signal SAMj (j=1, 2, . . . , N) is inputted as a control signal into the analog switch unit 52*j* connected to the data signal line SLj that corresponds to the sampling signal SAMj. Thereby, each analog switch unit 52*j* is in the on-state when the sampling signal SAMj, which is inputted thereto as the control signal, is active, and is in the off-state when the sampling signal SAMj is non-active. Thus, each data signal line SLj is provided with the analog video signal Video when the sampling signal SAMj corresponding thereto is active, and is electrically cut off from the video line 54 when the sampling signal SAMj is non-active. Since each data signal line SLj has a similar data signal line capacitance Csl to that in the above first embodiment, the analog video signal Video is sequentially sampled by the sampling signal SAMj and held in each data signal line capacitance Csl.

FIG. 20(B) is a circuit diagram showing a portion concerning one data signal line SLj, namely a unit sample-and-hold circuit, in the data signal line drive circuit of the dot sequential driving system as described above. This unit sample-and-hold circuit of FIG. 20(B) corresponds to the unit sample-and-hold circuit (FIG. 9) in the above first embodiment, and the analog video signal Video and the sampling signal SAMj provided to this unit sample-and-hold circuit of FIG. 20(B) respectively correspond to the video signal Sv1 and the connection switch control signal Sck provided to the unit sample-and-hold circuit (FIG. 9) in the above first embodiment. Further, each analog switch unit 52*j* is made up of an Nch transistor 61, and a parasitic capacitance CgdN is present between a gate terminal of this Nch transistor 61 and the data signal line SLj. For this reason, also in the unit sample-and-hold circuit of FIG. 20(B), a data signal line voltage decrease occurs due to the parasitic capacitance, as in the above first embodiment.

In order to reduce this data signal line voltage decrease by applying the present invention, it is considered that a waveform of the sampling signal SAMj that is provided to the gate terminal of the Nch transistor 61 as a switching element of each unit sample-and-hold circuit is made similar to the waveform of the connection switch control signal Sck that is shown in any of FIGS. 11(A), 11(B), 12(A) and 12(B) (j=1 to N). When a signal corresponding to the connection control intermediate-level period signal SCI shown in FIG. 4 in the above first embodiment (this signal is also referred to as "connection control intermediate-level period signal SCI") is provided from the display control circuit 400, the sampling signal SAMj with such a waveform can be generated in the sampling pulse generation circuit 510. According to the sampling pulse generation circuit 510 configured so as to generate the sampling signal SAMj with such a waveform, the data signal line voltage decrease is reduced, to obtain a similar effect to that of the above first embodiment. Similarly to the modified example (FIG. 19) of the above first embodiment, the Pch transistor may be used in place of the Nch transistor 61 as the switching element, or the CMOS analog switch may be used in place of the Nch transistor 61.

In the dot sequential driving system as described above, the time ensured for charging or discharging of the pixel capacitance in each pixel formation portion is short compared with the line sequential driving system. For this reason, when a displayed image has a high resolution, the original voltage (the voltage of the analog video signal Video) may not be held in the pixel capacitance, namely charging of the pixel capacitance may become insufficient. In contrast, there is known a display device employing a system of extending an analog video signal along its time base to lengthen a sampling period in order to ensure sufficient time for charging the pixel capacitance (hereinafter referred to as "phase development system"). In this phase development system, a signal obtained by extending an analog video signal along its time base by p times (p is an integer not smaller than 2) (this signal is referred to as "p-phase development signal") is provided to the data signal line drive circuit by p video lines. The present invention is also applicable to the display device of the phase development system as thus described.

Figure 21:
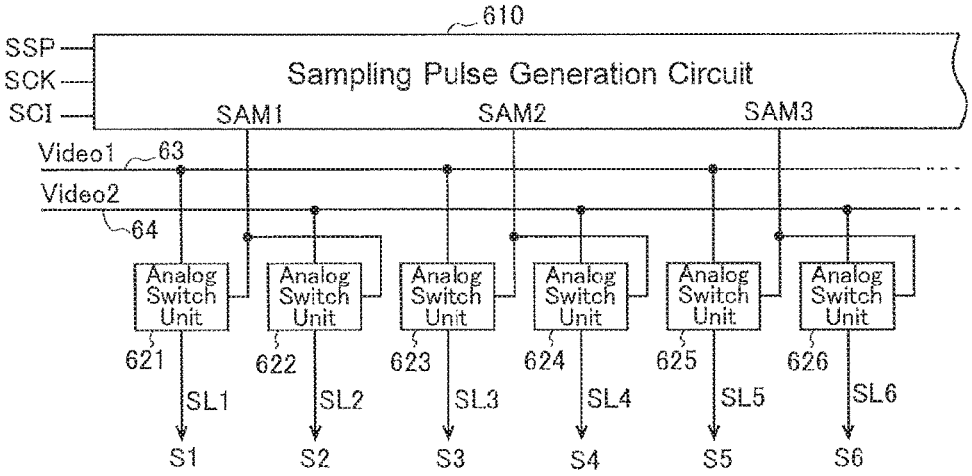
FIG. 21 is a block diagram showing a configuration of a data signal line drive circuit in a modified example of the other embodiment.
Figure 22:
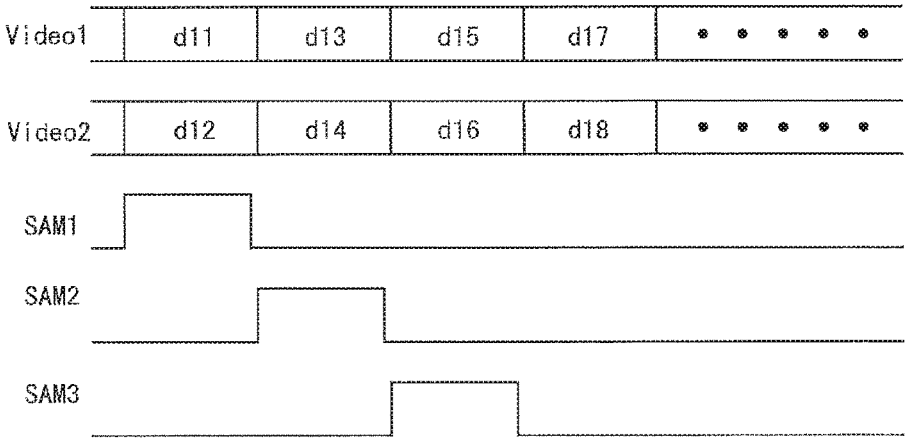
FIG. 22 is a timing chart for describing operation of the data signal line drive circuit in the modified example of the other embodiment.

FIG. 21 is a block diagram showing a configuration of the data signal line drive circuit in the display device of the phase development system, and FIG. 22 is a timing chart for describing operation of the data signal line drive circuit in the display device of the phase development system. This data signal line drive circuit is provided with a sampling pulse generation circuit 610, two video lines 63, 64, and an analog switch unit 62*j* provided correspondingly to each data signal line SLj (j=1 to N). This display device of the phase development system is basically similar to the display device in the above first embodiment (see FIG. 1) except for a configuration concerning the drive of data signal lines. Hence, the same or corresponding portion is provided with the same reference numeral, and the detailed description thereof is omitted. Note that the symbol dij added to the two phase development signals Video 1, video 2 as the analog video signals in FIG. 22 denotes pixel data to be written into (the pixel capacitance Cp of) the pixel formation portion 10 connected to the i-th scanning signal line GLi and the j-th data signal line SLj (i=1 to m, j=1 to N).

In this display device of the phase development system, two phase development signals Video 1, Video 2, each obtained by extending an analog video signal along its time base, are generated in a display control circuit (not shown), and respectively provided to the two video lines 63, 64 disposed in the date signal line drive circuit. Hence, each of the analog video signals (two phase development signals Video 1, Video 2) is sampled in a sampling cycle twice as long as compared with the data signal line drive circuit of the dot sequential driving system shown in FIG. 20. However, each analog switch unit 62*j* for this sampling has the same configuration as that of the analog switch unit 52*j* in the data signal line drive circuit shown in FIG. 20 (j=1 to N). Hence, the problem of the data signal line voltage decrease due to the parasitic capacitance also occurs in this data signal line drive circuit of the phase development system (FIG. 21). In order to reduce this data signal line voltage decrease by applying the present invention also in this data signal line drive circuit of the phase development system (FIG. 21), it is considered that a waveform of the sampling signal SAMj that is provided to the gate terminal of the Nch transistor constituting the analog switch unit 62*j* is made similar to the waveform of the connection switch control signal Sck that is shown in any of FIGS. 11(A), 11(B), 12(A) and 12(B) (j=1 to N). When a signal corresponding to the connection control intermediate-level period signal SCI shown in FIG. 4 in the above first embodiment (this signal is also referred to as "connection control intermediate-level period signal SCI") is provided from the display control circuit 400, the sampling signal SAMj with such a waveform can be generated in the sampling pulse generation circuit 610. According to the sampling pulse generation circuit 610 configured so as to generate the sampling signal SAMj with such a waveform, the data signal line voltage decrease is reduced, to obtain a similar effect to that of the above first embodiment. Similarly to the modified example (FIG. 19) of the above first embodiment, the analog switch unit 62*j* may be made up of the Pch transistor in place of the Nch transistor, or may be made up of the CMOS analog switch in place of the Nch transistor.

Figure 20:
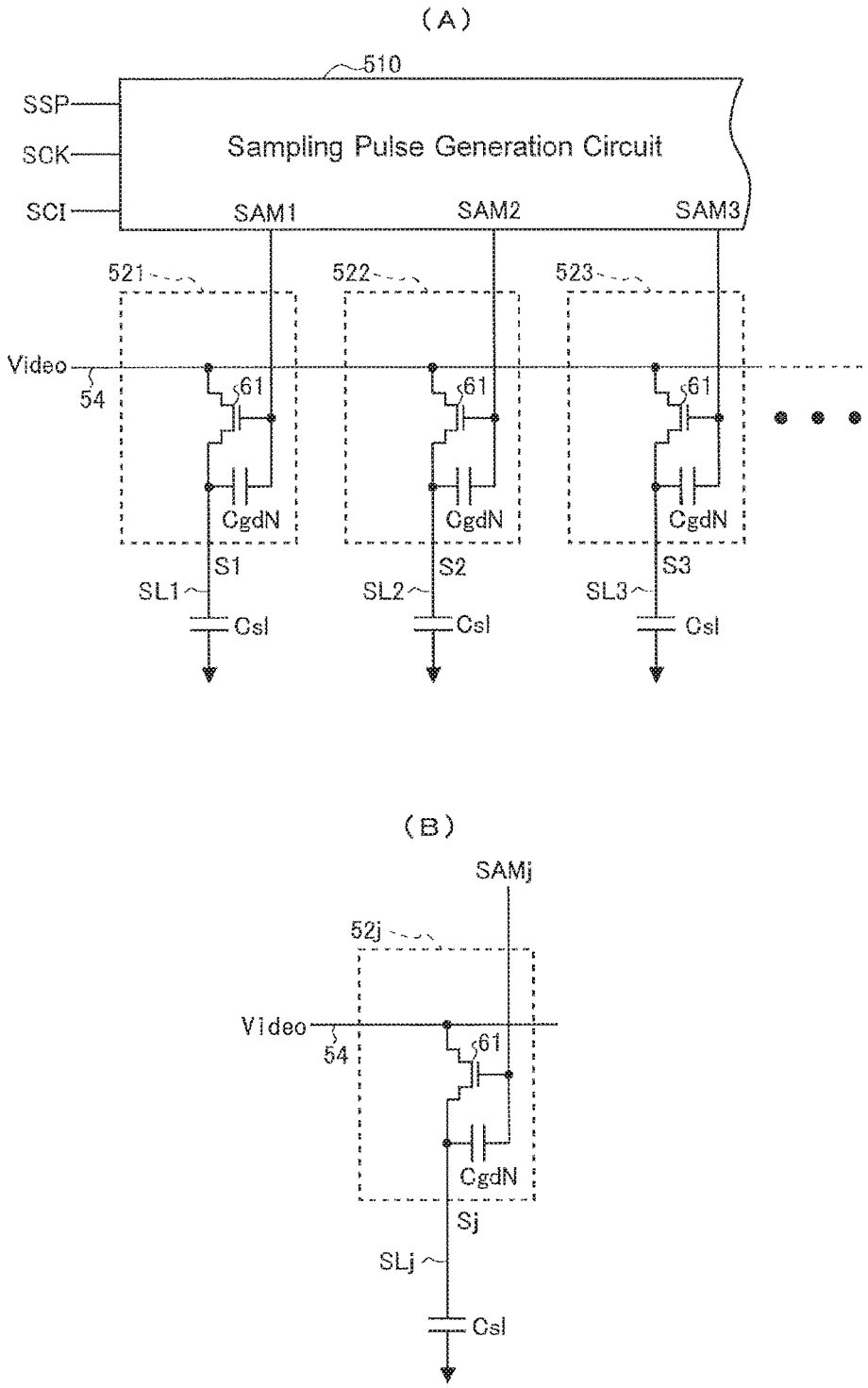
FIGS. 20(A) and 20(B) are circuit diagrams for describing a data signal line drive circuit in another embodiment of the present invention.

In the display device of the dot sequential driving system provided with the data signal line drive circuit as shown in FIG. 20, the length of the intermediate level period TCI (see FIGS. 11, 12) in the off-shift process of the analog switch unit 52*j* (j=1, 2, 3, . . . ) is the same in any sampling signal SAMj, but the length of the intermediate level period TCI may be varied depending on the sampling signal SAMj so as to make the signal line voltage decrease amount ΔVsl uniform in the display unit 120. That is, since the data signal line capacitance Csl is the largest at the center of the display region, namely in the portion where the data signal line SL is the longest, and is the smallest at both ends of the display region, namely in the portion where the data signal line SL is the shortest (FIG. 1), the intermediate level period TCI in the sampling signal SAMj corresponding to the connection switch control signal Sck shown in FIGS. 11 and 12 may be made the shortest in the sampling signal SAMj for obtaining the data signal Sj to be supplied to the center of the display region, and may be made the longest in the sampling signal SAMj for obtaining the data signal Sj to be supplied to both ends of the display region. This also applies to the display device of the phase development system provided with the data signal line drive circuit as shown in FIG. 21. When it is configured such that the sampling signals SAM1, SAM2, SAM3, . . . having the intermediate level period TCI as above are generated in the sampling pulse generation circuit 510 of FIG. 20 (or the sampling pulse generation circuit 610 of FIG. 21), the display unevenness can be reduced more effectively.

Figure 23:
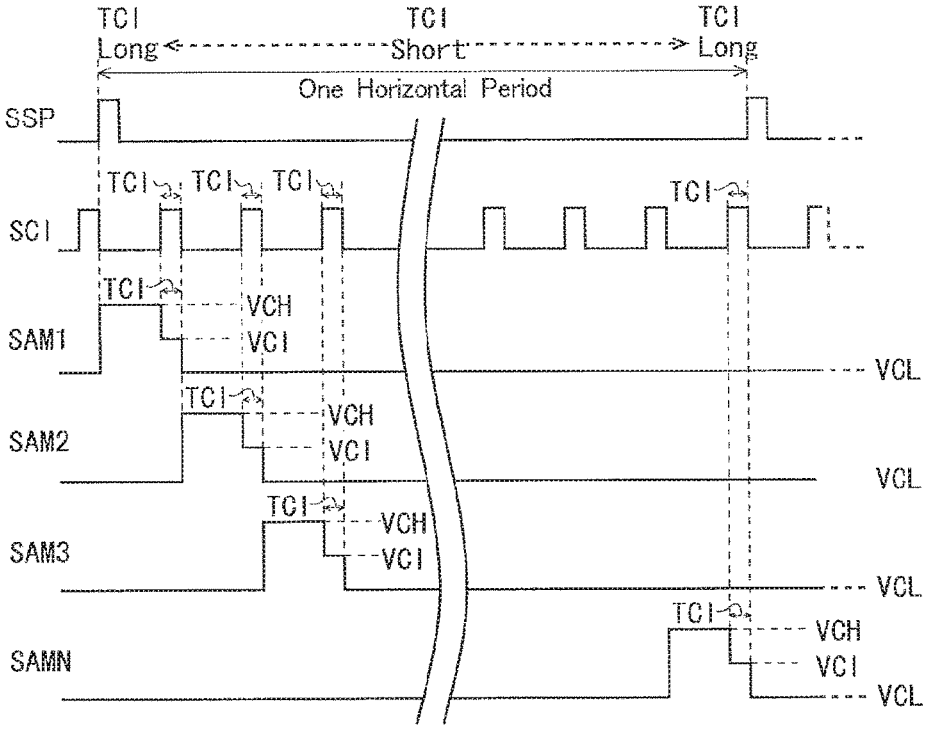
FIG. 23 is a signal waveform diagram for describing another configuration example for the data signal line drive circuit in the other embodiment.

For example, in order to achieve the configuration for generating the sampling signal SAMj corresponding to the connection switch control signal Sck with the waveform shown in FIG. 11(A), the connection control intermediate-level period signal SCI may be generated in each horizontal period such that, among pulses included in the connection control intermediate-level period signal SCI (a width of each of these pulses corresponds to the connection control intermediate level period TCI), the width of the pulse closest to the center point of the horizontal period is the shortest, the pulse width becomes longer as the pulse goes away from the center point, and the pulse width closest to the start point or the end point of the horizontal period is the longest, as shown in FIG. 23. When the connection control intermediate-level period signal SCI as above is generated in the display control circuit 400 and provided to the sampling pulse generation circuit 510 in the data signal line drive circuit, the sampling pulse generation circuit 510 can generate the sampling signal SMAj as above based on the connection control intermediate-level period signal SCI (see FIGS. 20, 23).

INDUSTRIAL APPLICABILITY

The present invention is applicable to an active matrix display device and a method for driving the same, which provide an analog video signal to each of a plurality of data signal lines connected to a plurality of pixel formation portions for forming an image to be displayed, and the present invention is especially suitable for a display device being such a display device as above and having a non-rectangular display unit, and a method for driving this display device.

DESCRIPTION OF REFERENCE CHARACTERS

10: pixel formation portion
12: TFT (thin film transistor)
50: connection control circuit
100: display panel
120: display unit (display region)
200: scanning signal line drive circuit (gate driver)
230: output circuit
300: data signal line drive circuit (source driver)
320: demultiplex circuit (sampling circuit)
322: demultiplexer
400: display control circuit Cgd: parasitic capacitance
Csl: data signal line capacitance
Cgl: scanning signal line capacitance
Cp: pixel capacitance
Ep: pixel electrode
SW1, SW2, SW3: analog switch (transistor)
GL1 to GLm: scanning signal line (gate line)
SL1 to SL3*n*: data signal line (source line)
S1 to S3*n*: data signal
Sc1, Sc2, Sc3: connection switch control signal (control signal of analog switch)
Sv1 to Svn: video signal (analog video signal)
VCH: H-level connection control voltage (on-voltage, first level voltage)
VCL: L-level connection control voltage (off-voltage, second level voltage)
VCI: intermediate level connection control voltage (intermediate level voltage)
VGH: H-level gate voltage (on-voltage, third level voltage)
VGL: L-level gate voltage (off-voltage, fourth level voltage)
VGI: intermediate level gate voltage (intermediate level voltage)
TCI: connection control intermediate level period
TGI: gate intermediate level period

The invention claimed is:

1. An active matrix display device comprising:

a display unit including a plurality of data signal lines, a plurality of scanning signal lines intersecting with the plurality of data signal lines, and a plurality of pixel formation portions arranged in a matrix form along the plurality of data signal lines and the plurality of scanning signal lines, the display unit having a non-rectangular shape in which lengths of at least two data signal lines of the plurality of data signal lines are different from each other;

an analog switch provided correspondingly to each of the plurality of data signal lines and including, as a connection control switching element, a field effect transistor which has a first conductive terminal configured to receive an analog video signal to be provided to the pixel formation portion connected to the corresponding data signal line, a second conductive terminal connected to the corresponding data signal line, and a control terminal configured to receive a connection switch control signal for switching between an on-state and an off-state; and a connection control circuit configured to generate the connection switch control signal such that time taken for a voltage of the connection switch control signal to change from a first level voltage for bringing the connection control switching element into an on-state to a second level voltage for bringing the connection control switching element into an off-state in turning off the connection control switching element is predetermined time in accordance with a length of time required for charging or discharging of a parasitic capacitance between the control terminal and the second conductive terminal via the connection control switching element; wherein the connection control circuit generates the connection switch control signal such that, the longer the corresponding data signal line, the shorter the predetermined time in the connection switch control signal to be provided to the control terminal of the connection control switching element.

2. The active matrix display device according to claim 1, wherein the connection control circuit generates the connection switch control signal such that the voltage of the connection switch control signal changes in a continuous manner from the first level voltage to the second level voltage or to a voltage in a vicinity of the second level voltage in turning off the connection control switching element.

3. The active matrix display device according to claim 1, wherein the connection control circuit generates the connection switch control signal such that the voltage of the connection switch control signal changes in a stepwise manner from the first level voltage to the second level voltage through at least one period for an intermediate level voltage in turning off the connection control switching element.

4. An active matrix display device, comprising:

a display unit including a plurality of data signal lines, a plurality of scanning signal lines intersecting with the plurality of data signal lines, and a plurality of pixel formation portions arranged in a matrix form along the plurality of data signal lines and the plurality of scanning signal lines, the display unit having a non-rectangular shape in which lengths of at least two data signal lines of the plurality of data signal lines are different from each other;

an analog switch provided correspondingly to each of the plurality of data signal lines and including, as a connection control switching element, a field effect transistor which has a first conductive terminal configured to receive an analog video signal to be provided to the pixel formation portion connected to the corresponding data signal line, a second conductive terminal connected to the corresponding data signal line, and a control terminal configured to receive a connection switch control signal for switching between an on-state and an off-state;

a connection control circuit configured to generate the connection switch control signal such that time taken for a voltage of the connection switch control signal to change from a first level voltage for bringing the connection control switching, element into an on-state to a second level voltage for bringing the connection control switching element into an off-state in turning off the connection control switching element is predetermined time in accordance with a length of time required for charging or discharging of a parasitic capacitance between the control terminal and the second conductive terminal via the connection control switching element; and a scanning signal line drive circuit configured to generate a plurality of scanning signals to be respectively provided to the plurality of scanning signal lines, wherein the display unit has a non-rectangular shape in which lengths of at least two scanning signal lines of the plurality of scanning signal lines are different from each other, each of the plurality of pixel formation portions includes a pixel electrode as one of electrodes that forms a predetermined capacitance, and a field effect transistor as a pixel switching element which has a first conductive terminal connected to any one of the plurality of data signal lines, a second conductive terminal connected to the pixel electrode, and a control terminal connected to any one of the plurality of scanning signal lines, and the scanning signal line drive circuit generates the plurality of scanning signals such that time taken for a voltage of the scanning signal provided to the control terminal to change from a third level voltage for bringing the pixel switching element into an on-state to a fourth level voltage for bringing the pixel switching element into an off-state in turning off the pixel switching element is predetermined time in accordance with a length of time required for charging or discharging of a parasitic capacitance between the control terminal and the second conductive terminal of the pixel switching element via the pixel switching element.

5. The active matrix display device according to claim 4, wherein the scanning signal line drive circuit generates the plurality of scanning signals such that the voltage of the scanning signal that is provided to the control terminal of the pixel switching element changes in a continuous manner from the third level voltage to the fourth level voltage or to a voltage in a vicinity of the fourth level voltage in turning off the pixel switching element.

6. The active matrix display device according to claim 4, wherein the scanning signal line drive circuit generates the plurality of scanning signals such that the voltage of the scanning signal that is provided to the control terminal of the pixel switching element changes in a stepwise manner from the third level voltage to the fourth level voltage through at least one period for an intermediate voltage in turning off the pixel switching element.

7. The active matrix display device according to claim 4, wherein the scanning signal line drive circuit generates the plurality of scanning signals such that, the longer the scanning signal line, the shorter the predetermined time in the scanning signal to be provided to the scanning signal line.

8. An active matrix display device comprising:

a display unit including a plurality of data signal lines, a plurality of scanning signal lines intersecting with the plurality of data signal lines, and a plurality of pixel formation portions arranged in a matrix form along the plurality of data signal lines and the plurality of scanning signal lines, the display unit having a non-rectangular shape in which lengths of at least two scanning signal lines of the plurality of scanning signal lines are different from each other; and a scanning signal line drive circuit configured to generate a plurality of scanning signals to be respectively provided to the plurality of scanning signal lines, wherein each of the plurality of pixel formation portions includes a pixel electrode as one of electrodes that forms a predetermined capacitance, and a field effect transistor as a pixel switching element which has a first conductive terminal connected to any one of the plurality of data signal lines, a second conductive terminal connected to the pixel electrode, and a control terminal connected to any one of the plurality of scanning signal lines, the scanning signal line drive circuit generates the plurality of scanning signals such that time taken for a voltage of the scanning signal provided to the control terminal to change from a third level voltage for bringing the pixel switching element into an on-state to a fourth level voltage for bringing the pixel switching element into an off-state in turning off the pixel switching element is predetermined time in accordance with a length of time required for charging or discharging of a parasitic capacitance between the control terminal and the second conductive terminal via the pixel switching element, and the scanning signal line drive circuit generates the plurality of scanning signals such that, the longer the scanning signal line, the shorter the predetermined time in the scanning signal to be provided to the scanning signal line.

9. The active matrix display device according to claim 8, wherein the scanning signal line drive circuit generates the plurality of scanning signals such that the voltage of the scanning signal that is provided to the control terminal of the pixel switching element changes in a continuous manner from the third level voltage to the fourth level voltage or to a voltage in a vicinity of the fourth level voltage in turning off the pixel switching element.

10. The active matrix display device according to claim 8, wherein the scanning signal line drive circuit generates the plurality of scanning signals such that the voltage of the scanning signal that is provided to the control terminal of the pixel switching element changes in a stepwise manner from the third level voltage to the fourth level voltage through at least one period for an intermediate voltage in turning off the pixel switching element.

11. A method for driving an active matrix display device provided with a display unit including a plurality of data signal lines, a plurality of scanning signal lines intersecting with the plurality of data signal lines, and a plurality of pixel formation portions arranged in a matrix form along the plurality of data signal lines and the plurality of scanning signal lines, the display unit having a non-rectangular shape in which lengths of at least two data signal lines of the plurality of data signal lines are different from each other, the method comprising the steps of:

controlling supply of an analog video signal to the corresponding data signal line by an analog switch provided correspondingly to each of the plurality of data signal lines and including, as a connection control switching element, a field effect transistor which has a first conductive terminal configured to receive the analog video signal to be provided to the pixel formation portion connected to the corresponding data signal line, a second conductive terminal connected to the corresponding data signal line, and a control terminal configured to receive a connection switch control signal for switching between an on-state and an off-state;

generating the connection switch control signal such that time taken for a voltage of the connection switch control signal to change from a first level voltage for bringing the connection control switching element into an on-state to a second level voltage for bringing the connection control switching element into an off-state in turning off the connection control switching element is predetermined time in accordance with a length of time required for charging or discharging of a parasitic capacitance between the control terminal and the second conductive terminal via the connection control switching element; and generating a plurality of scanning signals to be respectively provided to the plurality of scanning signal lines, wherein the display unit has a non-rectangular shape in which lengths of at least two scanning signal lines of the plurality of scanning signal lines are different from each other, each of the plurality of pixel formation portions includes a pixel electrode as one of electrodes that forms a redetermined capacitance, and a field effect transistor as a pixel switching element which has a first conductive terminal connected to any one of the plurality of data signal lines, a second conductive terminal connected to the pixel electrode, and a control terminal connected to any one of the plurality of scanning signal lines, and in the generating the plurality of scanning signals to be respectively provided to the plurality of scanning signal lines, the plurality of scanning signals are generated such that time taken for a voltage of the scanning signal provided to the control terminal of the pixel switching element to change from a third level voltage for bringing the pixel switching element into an on-state to a fourth level voltage for bringing the pixel switching element into an off-state in turning off the pixel switching element is predetermined time in accordance with a length of time required for charging or discharging of a parasitic capacitance between the control terminal and the second conductive terminal of the pixel switching element via the pixel switching element.

* * * * *